US011267244B2

(12) United States Patent
Kishigami et al.

(10) Patent No.: US 11,267,244 B2
(45) Date of Patent: Mar. 8, 2022

(54) LIQUID EJECTION HEAD

(71) Applicant: Brother Kogyo Kabushiki Kaisha, Nagoya (JP)

(72) Inventors: Toshihiro Kishigami, Obu (JP); Shotaro Kanzaki, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 122 days.

(21) Appl. No.: 16/835,422

(22) Filed: Mar. 31, 2020

(65) Prior Publication Data

US 2020/0307201 A1 Oct. 1, 2020

(30) Foreign Application Priority Data

Apr. 1, 2019 (JP) ..... JP2019-069634

(51) Int. Cl.
*B41J 2/14* (2006.01)
*B41J 2/175* (2006.01)

(52) U.S. Cl.
CPC ..... *B41J 2/14145* (2013.01); *B41J 2/1433* (2013.01); *B41J 2/17563* (2013.01); *B41J 2002/14306* (2013.01); *B41J 2002/14403* (2013.01); *B41J 2002/14419* (2013.01)

(58) Field of Classification Search
CPC ..... B41J 2/1433; B41J 2/175; B41J 2/17563; B41J 2/14145; B41J 2/18; B41J 2/14233; B41J 2002/14419; B41J 2002/14306; B41J 2202/12; B41J 2002/14362; B41J 2002/14403
See application file for complete search history.

(56) References Cited

U.S. PATENT DOCUMENTS

| | | | | |
|---|---|---|---|---|
| 8,534,810 | B2 | 9/2013 | Tsubaki | |
| 8,684,507 | B2 * | 4/2014 | Uezawa | B41J 2/14233 347/89 |
| 8,794,736 | B2 * | 8/2014 | Watanabe | B41J 2/14274 347/20 |
| 9,132,634 | B2 * | 9/2015 | Melde | B41J 2/19 |
| 11,040,544 | B2 * | 6/2021 | Bandoh | B41J 2/18 |
| 11,117,384 | B2 * | 9/2021 | Mizuno | B41J 2/14233 |
| 2012/0062659 | A1 | 3/2012 | Tsubaki | |
| 2018/0178538 | A1 | 6/2018 | Miyazawa et al. | |

FOREIGN PATENT DOCUMENTS

| | | |
|---|---|---|
| JP | 2012-056248 A | 3/2012 |
| JP | 2018-103616 A | 7/2018 |

* cited by examiner

*Primary Examiner* — An H Do

(74) *Attorney, Agent, or Firm* — Banner & Witcoff, Ltd.

(57) ABSTRACT

A liquid ejection head includes an individual channel, a first manifold, a filter, a second manifold, and a bypass path. The individual channel has a nozzle. The first manifold is in fluid communication with the individual channel. The filter is disposed in the first manifold. The second manifold is in fluid communication with the individual channel. The bypass path is positioned between the individual channel and the filter in a direction in which liquid flows. The bypass path extends from the first manifold. The bypass path provides fluid communication between the first manifold and the second manifold not via the individual channel.

21 Claims, 10 Drawing Sheets

LIQUID EJECTION HEAD

CROSS-REFERENCE TO RELATED APPLICATION

This application claims priority from Japanese Patent Application No. 2019-069634 filed on Apr. 1, 2019, the content of which is incorporated herein by reference in its entirety.

TECHNICAL FIELD

Aspects of the disclosure relate to a liquid ejection head that ejects liquid from nozzles.

BACKGROUND

An ink ejection head that ejects ink from nozzles has been known as a liquid ejection head that ejects liquid from nozzles. Such an ink ejection head includes a plurality of individual liquid chambers (e.g., individual channels), a common liquid chamber (e.g., a supply manifold), and a circulation common liquid chamber (e.g., a circulation manifold). The individual liquid chambers are in fluid communication with respective corresponding nozzles. The common liquid chamber allows ink to flow therefrom to the respective individual liquid chambers. The circulation common liquid chamber allows ink to flow thereinto from the respective individual liquid chambers. The ink ejection head further includes a filter disposed at one of end portions of the common liquid chamber. The end portion of the common liquid chamber where the filter is provided is closest to the individual liquid chambers. Such an ink ejection head may reduce or prevent precipitation of particles included in ink by ink circulation in which ink is caused to flow from the common liquid chamber to the circulation common liquid chamber via the individual liquid chambers.

SUMMARY

Nevertheless, each individual channel may impart a relatively high resistance to the flow of liquid therethrough. Thus, in a case where liquid is circulated via such individual channels in a liquid ejection head like the known ink ejection head, an amount of liquid to be circulated may be decreased. If a sufficient amount of liquid is not circulated, precipitation of particles included in liquid might not be reduced sufficiently in the liquid ejection head. In order to ensure sufficient amount of liquid circulation, a return path that may allow liquid to flow into a return manifold may be positioned in a supply manifold and liquid may be circulated in a head not via individual channels.

Nevertheless, in a case where such a return path is positioned upstream in a liquid flow direction from a filter disposed in a supply manifold, foreign matter may flow into the return path before reaching the filter, thereby not being caught by the filter. Foreign matter may thus adhere wall surfaces of the return path or remain in the return path, thereby causing increase of a resistance imparted to flow of liquid through the return path, thereby causing insufficient amount of liquid circulation.

Accordingly, aspects of the disclosure provide a liquid ejection head in which a sufficient amount of liquid may be surely circulated.

In one aspect of the disclosure, a liquid ejection head may include an individual channel, a first manifold, a filter, a second manifold, and a bypass path. The individual channel may have a nozzle. The first manifold may be in fluid communication with the individual channel. The filter may be disposed in the first manifold. The second manifold may be in fluid communication with the individual channel. The bypass path may be positioned between the individual channel and the filter in a direction in which liquid flows. The bypass path may extend from the first manifold. The bypass path may provide fluid communication between the first manifold and the second manifold not via the individual channel.

According to the one aspect of the disclosure, the bypass path that may provide fluid communication between the first manifold and the second manifold may be positioned between the filter and the individual channel in the direction in which liquid flows. Such a configuration may thus enable liquid to be circulated not via the individual channel that may impart a relatively high resistance to the flow of liquid therethrough. Further, such a configuration may enable liquid to flow into the bypass path after foreign matter included in liquid is removed by the filter. That is, liquid from which foreign matter has been removed may be circulated, thereby reducing or preventing foreign matter to adhere to wall surfaces of a circulation path or remain in the circulation path. Thus, increase of a channel resistance may be reduced. Consequently, a sufficient amount of liquid may be surely circulated.

DETAILED DESCRIPTION

Hereinafter, an illustrative embodiment will be described with reference to the accompanying drawings.

General Configuration of Printer

Figure 1:
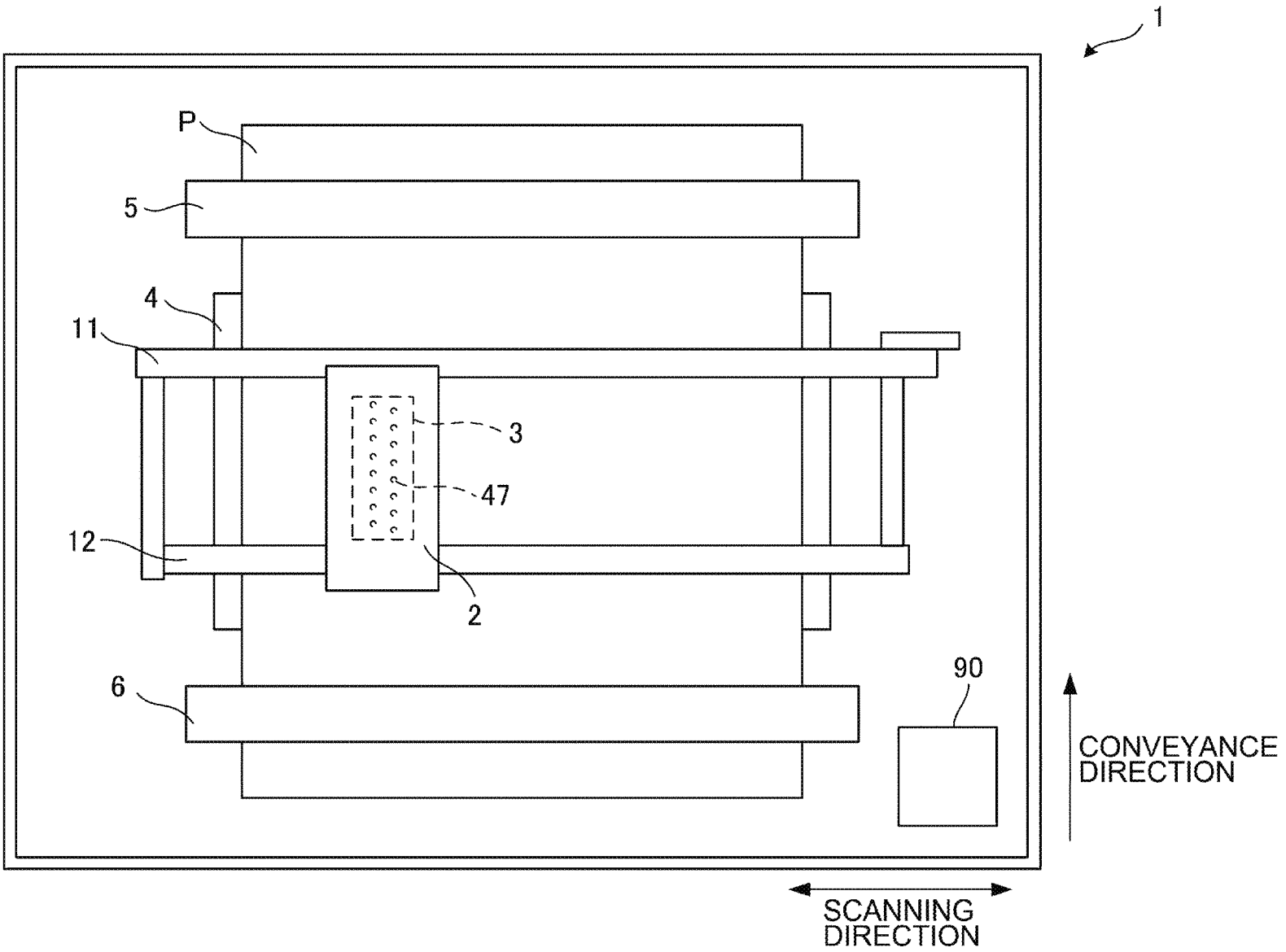
FIG. 1 is a plan view of a printer including an inkjet head according to an illustrative embodiment of the disclosure.

As illustrated in FIG. 1, a printer 1 includes a carriage 2, guide rails 11 and 12, an inkjet head 3 (e.g., a liquid ejection head), a platen 4, conveyance rollers 5 and 6, an ink tank 90, and pumps 91, 92, 93, and 94.

The carriage 2 is supported by the guide rails 11 and 12 extending in a scanning direction (e.g., a right-left direction in FIG. 1). The carriage 2 is configured to reciprocate in the scanning direction along the guide rails 11 and 12. The inkjet head 3 is mounted on the carriage 2. The inkjet head 3 is configured to move along the scanning direction together with the carriage 2. The inkjet head 3 is configured to be supplied with ink by the pumps 91 and 92, via tubes, from the ink tank 90 storing ink. Some of ink supplied to the inkjet head 3 is returned to the ink tank 90 by the pumps 93 and 94. The inkjet head 3 has a plurality of nozzles 47 defined in a lower surface. The inkjet head 3 is configured to eject ink droplets from the nozzles 47.

The platen 4 is disposed facing the lower surface of the inkjet head 3 and extends in the scanning direction to cover the entire width of a recording sheet P to be conveyed. The platen 4 is configured to support from below a recording sheet P being conveyed. The conveyance roller 5 is disposed downstream from the carriage 2 in a conveyance direction (e.g., a direction from the bottom of the drawing sheet of FIG. 2 toward the top of the drawing sheet of FIG. 2) perpendicular to the scanning direction. The conveyance roller 6 is disposed upstream from the carriage 2 in the conveyance direction. The conveyance rollers 5 and 6 are configured to convey a recording sheet Pin the conveyance direction.

The printer 1 is configured to perform printing on a recording sheet P by performing sheet conveyance and scanning alternately. In the sheet conveyance, the printer 1 conveys a recording sheet P by the conveyance rollers 5 and 6 by a certain distance in the conveyance direction. In the scanning, the printer 1 ejects ink droplets from one or more nozzles 47 of the inkjet head 3. That is, the printer 1 may be a serial printer. Hereinafter, a direction perpendicular to both the scanning direction and the conveyance direction may be referred to as an up-down direction.

Inkjet Head 3

Figure 2:
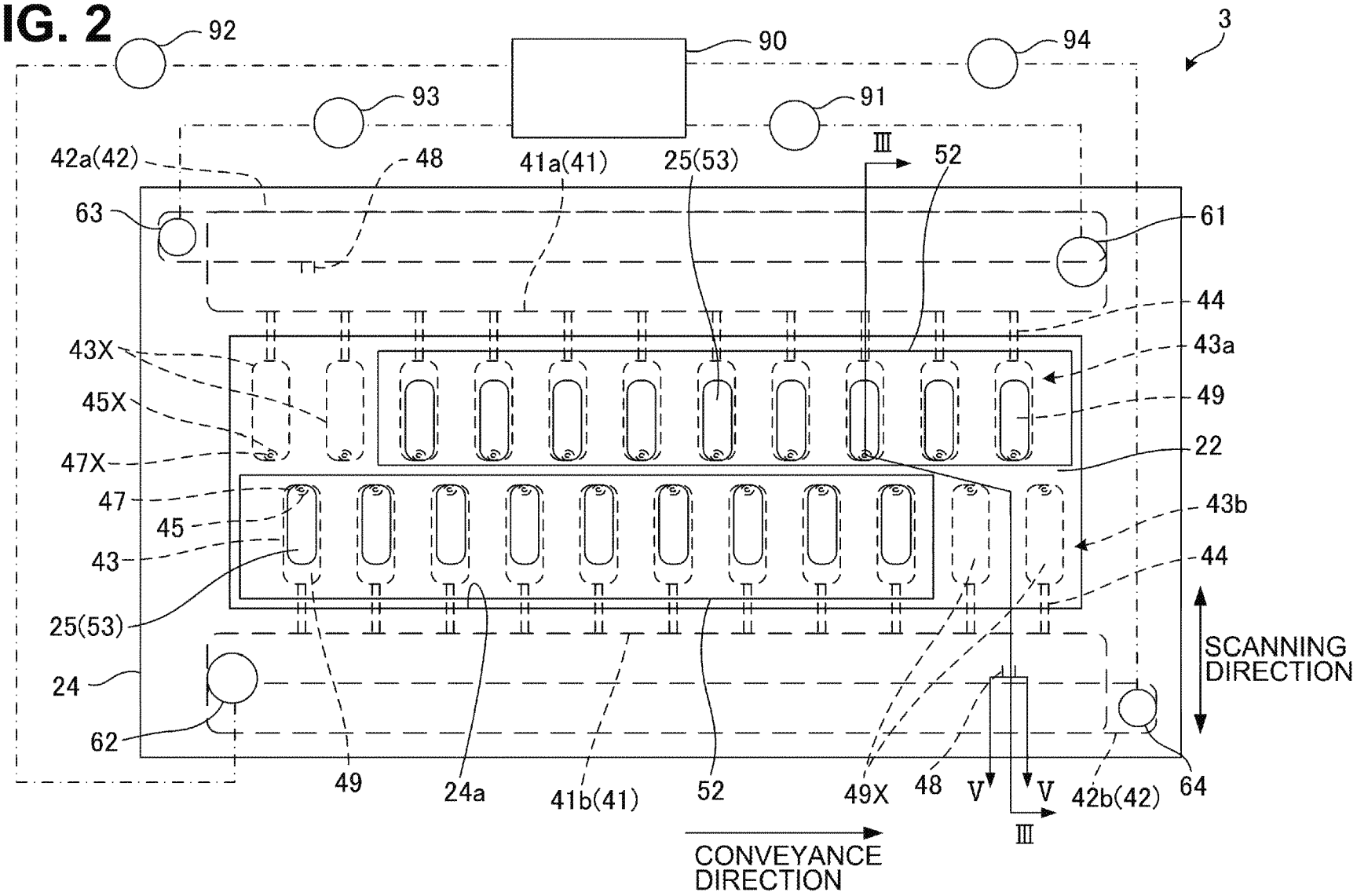
FIG. 2 is a plan view of the inkjet head of FIG. 1 according to the illustrative embodiment of the disclosure.
Figure 3:
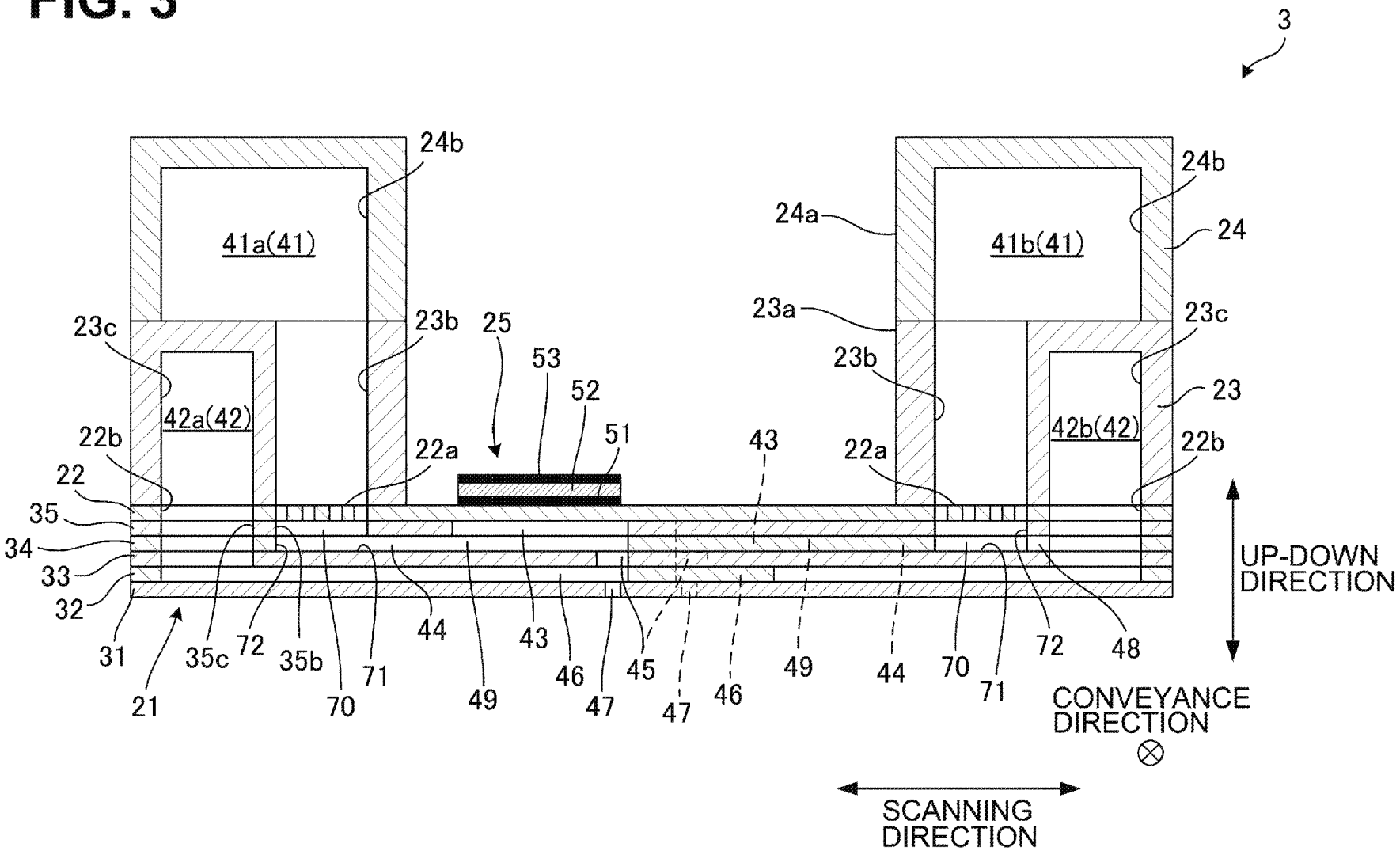
FIG. 3 is a sectional view taken along line of FIG. 2 according to the illustrative embodiment of the disclosure.

Referring to FIGS. 2 and 3, a detailed configuration of the inkjet head 3 will be described. As illustrated in FIG. 2, the inkjet head 3 has a rectangular shape in top plan view. More specifically, for example, when viewed in plan, longer sides of the inkjet head 3 extend in the conveyance direction. As illustrated in FIG. 3, the inkjet head 3 includes a channel member 21, a vibration plate 22, a first manifold member 23, a second manifold member 24, and common electrodes 51 (only one of which is illustrated), piezoelectric members 52 (only one of which is illustrated), and individual electrodes 53 (only one of which is illustrated). The common electrodes 51, the piezoelectric members 52, and the individual electrodes 53 constitute piezoelectric elements 25 (only one of which is illustrated).

As illustrated in FIGS. 2 and 3, the inkjet head 3 further includes a plurality of, for example, two supply manifolds 41*a* and 41*b*, a plurality of, for example, two return manifolds 42*a* and 42*b*, a plurality of individual channels 49, a plurality of dummy channels 49X, bypass paths 48, communication paths 44 and 46, inlets 61 and 62, and outlets 63 and 64. In the description below, the supply manifolds 41*a* and 41*b* may be indicated by a common reference numeral "41" when not distinguishing therebetween. The return manifolds 42*a* and 42*b* may be also indicated by a common reference numeral "42" when not distinguishing therebetween.

As illustrated in FIG. 2, the return manifolds 42*a* and 42*b* both extend in the conveyance direction. The return manifolds 42*a* and 42*b* are positioned at respective end portions of the channel member 21 in the scanning direction. More specifically, for example, the return manifold 42*a* is positioned at one end portion of the channel member 21 in the scanning direction. The return manifold 42*b* is positioned at the other end portion of the channel member 21 in the scanning direction. With respect to the scanning direction, the side on which the return manifold 42*b* is positioned may refer to one side and the side on which the return manifold 42*b* is positioned may refer to the other side.

As illustrated in FIG. 2, the supply manifolds 41*a* and 41*b* both extend in the conveyance direction. The supply manifolds 41*a* and 41*b* are positioned at the respective end portions of the channel member 21 in the scanning direction. More specifically, the supply manifold 41*a* is positioned at the one end portion of the channel member 21 in the scanning direction. The supply manifold 41*b* is positioned at the other end portion of the channel member 21 in the scanning direction. Each of the supply manifolds 41 have a length shorter than a length of a corresponding one of the return manifolds 42 in the conveyance direction.

When the inkjet head 3 is viewed in top plan, the supply manifold 41*a* and the return manifold 42*a* are positioned such that their downstream ends (e.g., right ends in FIG. 2) in the conveyance direction are aligned with each other. The return manifold 42*a* extends beyond an upstream end (e.g., a left end in FIG. 2) of the supply manifold 41*a* in the conveyance direction. When the inkjet head 3 is viewed in top plan, the supply manifold 41*b* and the return manifold 42*b* are positioned such that their upstream ends (e.g., left ends in FIG. 2) in the conveyance direction are aligned with each other. The return manifold 42*b* extends beyond the downstream end (e.g., a right end in FIG. 2) of the supply manifold 41*b* in the conveyance direction.

As illustrated in FIG. 3, each of the supply manifolds 41*a* and 41*b* has a cross section having an inverted L-shape in a plane extending perpendicular to the conveyance direction. More specifically, for example, a particular portion of each of the supply manifolds 41*a* and 41*b* extends in the up-down direction and an upper portion of each of the supply manifolds 41*a* and 41*b* extends in the scanning direction toward a respective corresponding end of the inkjet head 3 in the scanning direction from the particular portion thereof. The supply manifold 41*a* is disposed such that the particular portion of the supply manifold 41*a* is positioned to the other side (e.g., the right) of the return manifold 42*a* in the scanning direction and the upper portion of the supply manifold 41*a* is positioned above the return manifold 42*a*. The particular portion and the upper portion of the supply manifold 41*a* are contiguous with each other. The supply manifold 41*b* is disposed such that the particular portion of the supply manifold 41*b* is positioned to the one side (e.g., the left) of the return manifold 42*b* in the scanning direction and the upper portion of the supply manifold 41*b* is positioned above the return manifold 42*b*. The particular portion and the upper portion of the supply manifold 41*b* are contiguous with each other. The supply manifold 41 and the return manifold 42 that are adjacent to each other are in fluid communication with each other via the bypass path 48 but not via the individual channels 49 and the dummy channels 49X.

When the inkjet head 3 is viewed in top plan, the individual channels 49 and the dummy channels 49X are positioned without overlapping the supply manifolds 41 and the return manifolds 42. The supply manifolds 41 are positioned closer to respective ends of the inkjet head 3 in the scanning direction than the individual channels 49 and the dummy channels 49X are to the ends of the inkjet head 3 in the scanning direction. The return manifolds 42 are positioned closer to the respective ends of the inkjet head 3 in the scanning direction than the individual channels 49 and the dummy channels 49X are to the ends of the inkjet head 3 in the scanning direction. Each individual channel 49 includes a pressure chamber 43, a descender 45, and a nozzle 47. The dummy channels 49X may have the same or similar configuration to the individual channels 49. That is, each dummy channel 49X includes a pressure chamber 43X, a descender 45X, and a nozzle 47X. The inkjet head 3 might not eject ink droplets from the nozzles 47X of the dummy channels 49X.

As illustrated in FIG. 2, the pressure chambers 43 corresponding to the respective individual channels 49 and the pressure chambers 43X corresponding to the respective dummy channels 49X are arranged in two rows, for example, pressure chamber rows 43*a* and 43*b*, and in a staggered pattern. More specifically, for example, the pressure chamber row 43*a* includes some of the pressure chambers 43 and some of the pressure chambers 43X aligned in the conveyance direction at equal intervals. The pressure chamber row 43*b* includes the remainder of the pressure chambers 43 and the remainder of the pressure chambers 43X aligned in the conveyance direction at equal intervals. The pressure chamber rows 43*a* and 43*b* are positioned next to each other in the scanning direction.

Each of the pressure chamber rows 43*a* and 43*b* includes two pressure chambers 43X of the respective dummy channels 49X. As illustrated in FIG. 2, the pressure chamber row 43*a* is positioned to the one side of the pressure chamber row 43*b* in the scanning direction. In the pressure chamber row 43*a*, the most and second most upstream pressure chambers in the conveyance direction (e.g., the leftmost and second leftmost pressure chambers in FIG. 2) may be the pressure chambers 43X. That is, the pressure chamber row 43*a* includes the pressure chambers 43X following the endmost one of the pressure chambers 43X. The pressure chamber row 43*b* is positioned to the other side of pressure chamber row 43*a* in the scanning direction. In the pressure chamber row 43*b*, the most and second most downstream pressure chambers in the conveyance direction (e.g., the rightmost and second rightmost pressure chambers in FIG. 2) may be the pressure chambers 43X. That is, the pressure chamber row 43*b* includes the pressure chambers 43X following the endmost one of the pressure chambers 43.

In each of the pressure chamber rows 43*a* and 43*b*, the dummy channels 49X include a first dummy channel 49X and a second dummy channel 49X corresponding to respective pressure chambers 43X that may be the endmost pressure chambers. The first dummy channel 49X (e.g., the dummy channel 49X corresponding the endmost pressure chamber 43X) is not next to the endmost one of the individual channels 49, and the second dummy channel 49X (e.g., the dummy channel 49X corresponding to the second endmost pressure chamber 43X) is next to the endmost one of the individual channels 49. The first dummy channel 49X may impart less resistance to the flow of ink therethrough than the second dummy channel 49X imparts a resistance to the flow of ink therethrough.

As illustrated in FIG. 2, the bypass path 48 providing fluid communication between the supply manifold 41*a* and the return manifold 42*a* is positioned in the conveyance direction between the dummy channels 49X including the respective pressure chambers 43X that may be the most upstream two pressure chambers (e.g., the leftmost and second leftmost pressure chambers) belonging to the pressure chamber row 43*a* in the conveyance direction in top plan view. The bypass path 48 providing fluid communication between the supply manifold 41*b* and the return manifold 42*b* is positioned in the conveyance direction between the dummy channels 49X including the respective pressure chambers 43X that may be the most downstream two pressure chambers (e.g., the rightmost and second rightmost pressure chambers) belonging to the pressure chamber row 43*b* in the conveyance direction in top plan view.

The pressure chambers 43 and 43X belonging to the pressure chamber row 43*a* are each in fluid communication with the supply manifold 41*a* via a respective corresponding communication path 44 (e.g., a second communication path or a first narrowed portion). That is, the supply manifold 41*a* is provided in common for the pressure chambers 43 and 43X belonging to the pressure chamber row 43*a*. The communication paths 44 are provided for the pressure chambers 43 and 43X belonging to the pressure chamber row 43*a* in a one-to-one correspondence. Each communication path 44 is connected to one end of a corresponding one of the pressure chambers 43 and 43X in the scanning direction. That is, each communication path 44 connects between a corresponding one of the individual channels 49 and the dummy channel 49X and a corresponding supply manifold 41*a*.

The pressure chambers 43 and 43X belonging to the pressure chamber row 43*b* are each in fluid communication with the supply manifold 41*b* via a respective corresponding communication path 44 (e.g., the second communication path or the first narrowed portion). That is, the supply manifold 41*b* is provided in common for the pressure chambers 43 and 43X belonging to the pressure chamber row 43*b*. The communication paths 44 are provided for the pressure chambers 43 and 43X belonging to the pressure chamber row 43*b* in a one-to-one correspondence. Each communication path 44 is connected to the other end of a corresponding one of the pressure chambers 43 and 43X in the scanning direction. That is, each communication path 44 connects between a corresponding one of the individual channels 49 and the dummy channel 49X and a corresponding supply manifold 41*b*.

Referring to FIG. 3, the descenders 45 and 45X will be described in detail. All of the descenders 45 and 45X may have the same configuration, and therefore, one of the descenders 45 and 45X will be described. As illustrated in FIG. 3, a descender 45, 45X is positioned between a pressure chamber 43, 43X and a nozzle 47, 47X in the up-down direction. In FIG. 3, only two each of the descenders 45 and 45X, the pressure chambers 43 and 43X, and the nozzles 47 and 47X are illustrated. The descender 45, 45X is in fluid communication with the one end or the other end of a corresponding pressure chamber 43, 43X in the scanning direction. The end of the pressure chamber 43, 43X that is fluid communication with the descender 45, 45X is opposite to the end of the pressure chamber 43, 43X that is connected to a corresponding communication path 44. That is, the descender 45, 45X corresponding to the pressure chamber 43, 43X belonging to the pressure chamber row 43*a* is in fluid connection with the other end of the pressure chamber 43, 43X in the scanning direction. The descender 45, 45X corresponding to the pressure chamber 43, 43X belonging to the pressure chamber row 43*b* is in fluid connection with the one end of the pressure chamber 43 in the scanning direction.

As illustrated in FIG. 3, the descender 45, 45X that is in fluid communication with a corresponding pressure chamber 43, 43X belonging to the pressure chamber row 43*a* is in fluid communication with the return manifold 42*a* via a corresponding one of communication paths 46 (e.g., a first communication path or a second narrowed portion). That is, the return manifold 42*a* is provided in common for the pressure chambers 43 and 43X belonging to the pressure chamber row 43*a*. The communication paths 46 are provided for the descenders 45 and 45X that are in fluid communication with the respective corresponding pressure chambers 43 and 43X belonging to the pressure chamber row 43*a* in a one-to-one correspondence. That is, each communication path 46 connects between a corresponding one of the individual channels 49 and the dummy channels 49X and a corresponding return manifold 42*a*.

In a similar manner to the descender 45, 45X that is in fluid communication with a corresponding pressure chamber 43, 43X belonging to the pressure chamber row 43*a*, the descender 45, 45X that is in fluid communication with a corresponding pressure chamber 43, 43X belonging to the pressure chamber row 43*b* is in fluid communication with the return manifold 42*b* via a corresponding one of the communication paths 46 (e.g., the first communication path or the second narrowed portion). That is, the return manifold 42*b* is provided in common for the pressure chambers 43 and 43X belonging to the pressure chamber row 43*b*. The communication paths 46 are provided for the descenders 45 and 45X that are in fluid communication with the respective corresponding pressure chambers 43 and 43X belonging to the pressure chamber row 43*b* in a one-to-one correspondence. That is, each communication path 46 connects between a corresponding one of the individual channels 49 and the dummy channels 49X and a corresponding return manifold 42*b*.

Referring to FIGS. 4A to 4E, a configuration of the channel member 21 will be described. As illustrated in FIG. 3, the channel member 21 includes a plurality of, for example, five plates 31, 32, 33, 34, and 35 laminated one above another in this order from below. The plates 31 to 35 have the same outside shape. For example, the plates 31 to 35 each have a rectangular shape having longer sides extending in the conveyance direction in top plan view.

Figure 4A:
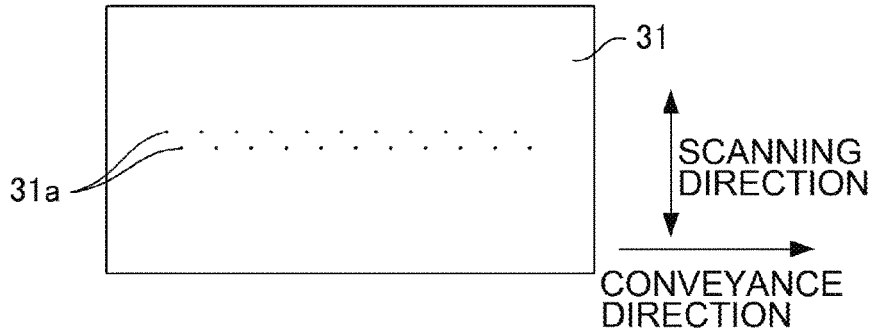
FIGS. 4A, 4B, 4C, 4D, and 4E are plan views each illustrating one of plates constituting a channel member according to the illustrative embodiment of the disclosure.

As illustrated in FIG. 4A, the plate 31 has a plurality of through holes 31*a* in its middle portion in the scanning direction. The through holes 31*a* are arranged in two rows and in a staggered pattern along the conveyance direction. The through holes 31*a* each have openings in respective surfaces of the plate 31. The openings of the through holes 31*a* in the lower surface of the plate 31 correspond to the respective nozzles 47 and 47X. That is, the plate 31 has the nozzles 47 and 47X.

Figure 4B:
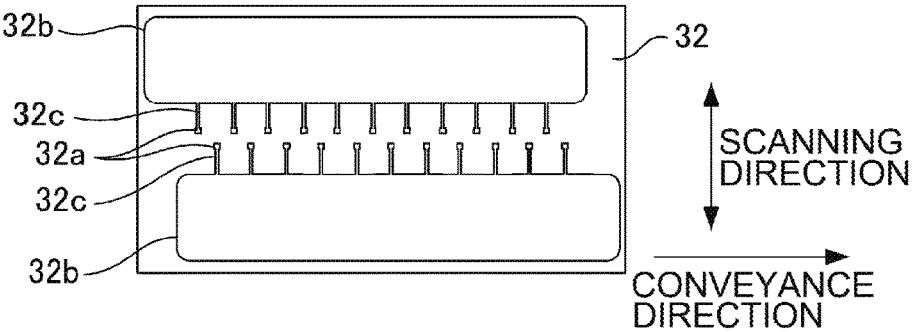

As illustrated in FIG. 4B, the plate 32 has a plurality of through holes 32*a* in its middle portion in the scanning direction. The through holes 32*a* are arranged in two rows and in a staggered pattern along the conveyance direction. The plate 32 has the through holes 31*a* in its portion that may face the portion of the plate 31 where the thorough holes 31*a* are defined. Each through hole 32*a* constitutes a particular portion of a corresponding descender 45, 45X that is in fluid communication with a corresponding nozzle 47, 47X. The plate 32 further has through holes 32*b* on opposite sides of the two rows consisting of the through holes 32*a* with respect to the scanning direction. Each through hole 32*b* extends along the conveyance direction. Each through hole 32*b* constitutes a first portion of a corresponding return manifold 42. The plate 32 further has through holes 32*c*. Each through hole 32*c* extends toward one end or the other end of the plate 32 in the scanning direction to reach a corresponding through hole 32*b* from a corresponding one of the through holes 32*a*. Each through hole 32*c* constitutes a corresponding communication path 46. That is, the plate 32 defines the particular portions of the descenders 45, 45X that are in fluid communication with the respective nozzles 47, 47X, the first portions of the return manifolds 42, and the particular portions of the communication paths 46, each of which provides fluid communication with the particular portion of a corresponding one of the descenders 45, 45X and the first portion of a corresponding one of the return manifolds 42.

Figure 4C:
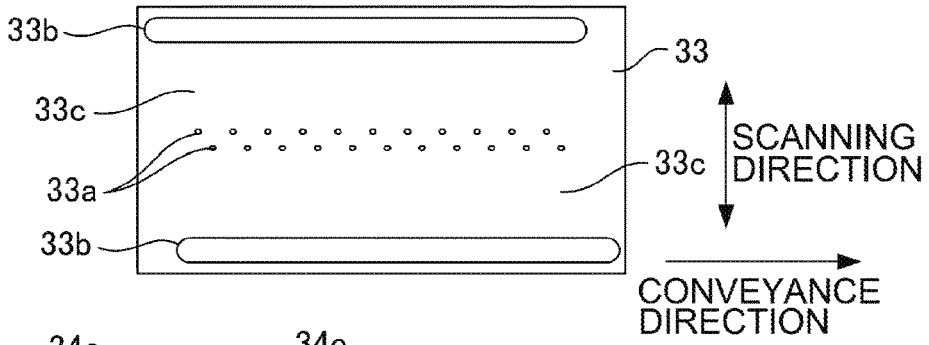

As illustrated in FIG. 4C, the plate 33 has a plurality of through holes 33*a* in its middle portion in the scanning direction. The through holes 33*a* are arranged in two rows and in a staggered pattern along the conveyance direction. The plate 33 has the through holes 33*a* in its portion that may face the portion of the plate 32 where the thorough holes 32*a* are defined. Each through hole 33*a* constitutes a further particular portion of a corresponding descender 45, 45X. The plate 33 further has through holes 33*b* in respective end portions of the plate 33 in the scanning direction. Each through hole 33*b* extends along the conveyance direction. The plate 33 has the through holes 33*b* in its portion that may face the portion of the plate 32 where the thorough holes 32*b* are defined. Each through hole 33*b* constitutes a second portion of a corresponding return manifold 42. The plate 33 includes wall portions 33*c* (e.g., a first wall portion) each serving as an upper wall surface (e.g., a surface extending perpendicular to the up-down direction) of corresponding ones of the communication paths 46 between adjacent through holes 33*a* and 33*b* in the scanning direction. That is, the plate 33 defines the further particular portions of the descenders 45, 45X, the second portions of the return manifolds 42, and the wall portions 33*c* serving as the respective upper surfaces of the communication paths 46.

Figure 4D:
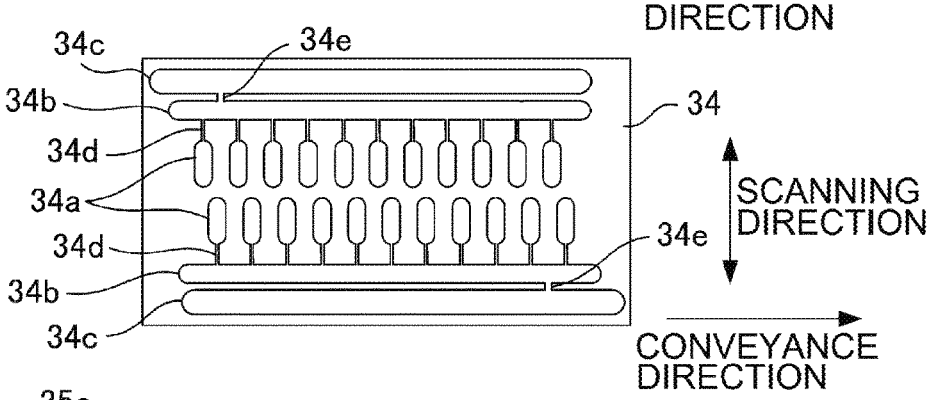

As illustrated in FIG. 4D, the plate 34 has through holes 34*a*. Each through hole 34*a* extends toward one end or the other end of the plate 34 in the scanning direction from a portion of the plate 34 that may face the portion of the plate 33 where the through holes 33*a* are arranged in a staggered pattern. Each through hole 34*a* constitutes a particular portion of a corresponding pressure chamber 43, 43X that is in fluid communication with a corresponding descender 45, 45X. The plate 34 further has through holes 34*b* on opposite sides of the through holes 34*a* with respect to the scanning direction. Each through hole 34*b* extends along the conveyance direction. Each through hole 34*b* constitutes a particular portion of a corresponding supply manifold 41. The plate 34 further has through holes 34*c* in respective end portions of the plate 34 in the scanning direction. Each through hole 34*c* extends along the conveyance direction. In each of the half portions of the plate 34 in the scanning direction, a through hole 34*c* and a through hole 34*a* row are positioned opposite sides of a through hole 34*b*. The plate 34 has the through holes 34*c* in its portion that may face the portion of the plate 33 where the thorough holes 33*b* are defined. Each through hole 34*c* constitutes a third portion of a corresponding return manifold 42.

The plate 34 further has through holes 34*d*. Each through hole 34*d* extends toward one end or the other end of the plate 34 in the scanning direction to reach a corresponding through hole 34*b* from a corresponding one of the through holes 34*a*. More specifically, for example, the through holes 34*d* extending from the respective through holes 34*a* belonging the one-side row in the scanning direction extend toward the one end of the plate 34 in the scanning direction. The through holes 34*d* extending from the respective through holes 34*a* belonging the other-side row in the scanning direction extend toward the other end of the plate 34 in the scanning direction. Each through hole 34*d* constitutes a corresponding communication path 44.

Figure 5:
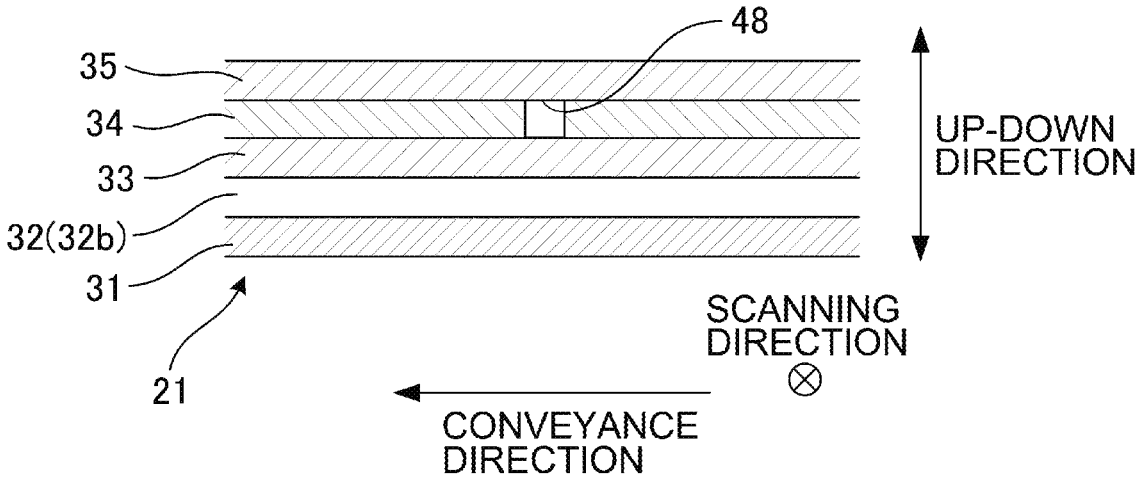
FIG. 5 is a partial sectional view of the channel member taken along line V-V of FIG. 2 according to the illustrative embodiment of the disclosure.

The plate 34 further has through holes 34*e* in the respective end portions of the plate 34 in the scanning direction. Each through hole 34*e* connects between a corresponding through hole 34*b* and a corresponding through hole 34*c*. The through holes 34*b* and 34*c* positioned in the one end portion of the plate 34 are connected with each other at their upstream end portions in the conveyance direction by a through hole 34*e*. The through holes 34*b* and 34*c* positioned in the other end portion of the plate 34 are connected with each other at their downstream end portions in the conveyance direction by another through hole 34*e*. Each through hole 34*e* constitutes a corresponding bypass path 48. Each bypass path 48 extends along the scanning direction. As illustrated in FIG. 5, a cross section of each bypass path 48 in a plane perpendicular to a direction in which ink flows (hereinafter, referred to as the "ink flow direction") in a bypass path 48 may have a rectangular shape. The ink flow direction in the bypass path 48 may correspond to the scanning direction.

That is, the plate 34 defines the particular portions of the pressure chambers 43, 43X that are in fluid communication with the respective descenders 45, 45X, the particular portions of the supply manifolds 41, the third portions of the return manifolds 42, the particular portions of the communication paths 44, each of which provides fluid communication with the particular portion of a corresponding one of the pressure chambers 43, 43X and the particular portion of a corresponding one of the supply manifolds 41, and the bypass paths 48.

Figure 4E:
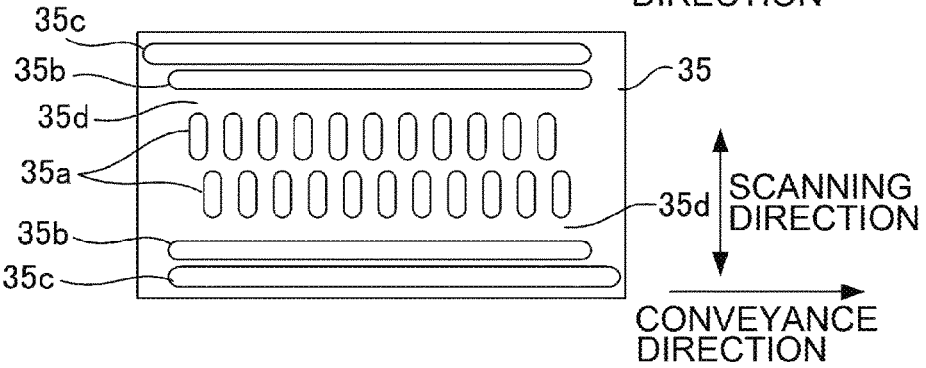

As illustrated in FIG. 4E, the plate 35 has a plurality of through holes 35*a* in its middle portion in the scanning direction. The through holes 35*a* are arranged in two rows and in a staggered pattern along the conveyance direction. The plate 35 has the through holes 35*a* in its portion that may face the portion of the plate 34 where the thorough holes 34*a* are defined. Each through hole 35*a* constitutes a further particular portion of a corresponding pressure chamber 43, 43X. The plate 35 further has through holes 35*b* on opposite sides of the two rows consisting of the through holes 35*a* with respect to the scanning direction. Each through hole 35*b* extends along the conveyance direction. The plate 35 has the through holes 35*b* in its portion that may face the portion of the plate 34 where the thorough holes 34*b* are defined. Each through hole 35*b* constitutes a further particular portion of a corresponding supply manifold 41. The plate 35 further has through holes 35*c* in respective end portions of the plate 35 in the scanning direction. Each through hole 35*c* extends along the conveyance direction. In each of the half portions of the plate 35 in the scanning direction, a through hole 35*c* and a through hole 35*a* row are positioned opposite sides of a through hole 35*b*. The plate 35 has the through holes 35*c* in its portion that may face the portion of the plate 34 where the thorough holes 34*c* are defined. Each through hole 35*c* constitutes a fourth portion of a corresponding return manifold 42.

The plate 35 includes wall portions 35*d* (e.g., a second wall portion) each serving as an upper wall surface (e.g., a surface extending perpendicular to the up-down direction) of corresponding ones of the communication paths 44 between adjacent through holes 35*a* and 35*b* in the scanning direction. That is, the plate 35 defines the further particular portions of the pressure chambers 43, 43X, the wall portions 35*d* serving as the upper surfaces of the communication paths 44, the further particular portions of the supply manifolds 41, and the fourth portions of the return manifolds 42.

In the channel member 21, the plates 34 and 35 define the pressure chambers 43 and 43X. The plates 32 and 33 define the descenders 45 and 45X. The plates 34 and 35 define the particular portion and the further particular portion of each supply manifold 41. The plates 32, 33, 34, and 35 define the first, second, third, and fourth portions of each return manifold 42. The plate 34 defines the bypass paths 48.

The vibration plate 22 (e.g., a filter member) has the same outside shape as the plates 31 to 35 in top plan view. The vibration plate 22 is laminated on an upper surface of the channel member 21, that is, an upper surface of the plate 35. As illustrated in FIG. 3, the vibration plate 22 includes a plurality of, two filters 22*a* at respective positions where the filters 22*a* may face the respective through holes 35*b* each constituting the further particular portion of a corresponding supply manifold 41 of the plate 35. The vibration plate 22 further has through holes 22*b* each constituting a fifth portion of a corresponding return manifold 42. The vibration plate 22 has the through holes 22*b* in its respective portions that may face the portions of the plate 35 where the through holes 35*c* each constituting the fourth portion of a corresponding return manifold 42 are defined.

Although only one of the bypass paths 48 is illustrated in FIG. 3, both the bypass paths 48 have the same configuration. Therefore, one of the bypass paths 48 will be described in detail. As illustrated in FIG. 3, the bypass path 48 is positioned between a channel row consisting of corresponding ones of the individual channels 49 and dummy channels 49X and a filter 22*a* in the ink flow direction. The bypass path 48 extends from the supply manifold 41. A section of the supply manifold 41 between a channel row consisting of corresponding ones of the individual channels 49 and dummy channels 49X and a filter 22*a* may be referred to as a path 70. The supply manifold 41 has a first surface 71 and a second surface 72. The first surface 71 defines a bottom surface of the path 70. The second surface 72 defines a side surface of the path 70 that is a surface closer to an end of the inkjet head 3 in the scanning direction (e.g., closer to the return manifold 42) than an opposite side surface of the path 70 in the scanning direction. The first surface 71 is included in an upper surface of the plate 33. The second surface 72 defines a side surface of the through hole 34*b* (refer to FIG. 4D) of the plate 34 constituting the particular portion of the supply manifold 41 and a side surface of the through hole 35*b* (refer to FIG. 4E) of the plate 35 constituting the further particular portion of the supply manifold 41.

The path 70 has a corner where the first surface 71 and the second surface 72 intersect each other. The bypass path 48 is defined at the corner. More specifically, for example, the bypass path 48 has an opening defined at a lower end portion of the second surface 72. The bypass path 48 has a lower surface included in the upper surface of the plate 33 as well as the first surface 71. That is, the lower surface of the bypass path 48 is flush with the bottom surface of the path 70.

The inkjet head 3 further includes a common electrode 51, a piezoelectric member 52, and individual electrodes 53 in this order from below on an upper surface of the vibration plate 22 at each particular portion that may face corresponding ones of the pressure chambers 43. A common electrode 51 and a piezoelectric member 52 are provided on a pressure chamber row basis. More specifically, for example, a common electrode 51 and a piezoelectric member 52 extend over the pressure chambers 43 belonging to a corresponding one of the pressure chamber rows 43*a* and 43*b*. An individual electrode 53 is provided on a pressure chamber basis. The individual electrodes 53 overlap the respective pressure chambers 43 in top plan view. An individual electrode 53, a particular portion of the common electrode 51 facing the individual electrode 53, and a particular portion of the piezoelectric member 52 facing the individual electrode 53 constitute a piezoelectric element 25. That is, piezoelectric elements 25 are disposed on the upper surface of the vibration plate 22 in a one-to-one correspondence to the pressure chambers 43. As illustrated in FIG. 2, no piezoelectric element 25 is provided for the pressure chambers 43X of the dummy channels 49X.

The individual electrodes 53 are connected to a driver IC via leads. The driver IC is configured to, while maintaining the potential of the common electrodes 51 at the ground potential, change the potential of appropriate ones of the individual electrodes 53. With such an operation of the driver IC, a portion of the vibration plate 22 and a portion of the piezoelectric member 52 both sandwiched between an individual electrode 53 and a pressure chamber 43 is deformed to protrude toward the pressure chamber 43. The volume of the pressure chamber 43 is thus reduced and pressure acting on ink in the pressure chamber 43 increases, thereby causing ink ejection from a corresponding nozzle 47 that is in fluid communication with the pressure chamber 43.

As illustrated in FIG. 3, the first manifold member 23 is laminated on the upper surface of the vibration plate 22 and out of position with respect to the piezoelectric elements 25. More specifically, for example, the first manifold member 23 is laminated on the upper surface of the vibration plate 22 without overlapping the piezoelectric elements 25 positioned on the upper surface of the vibration plate 22 in top plan view. The second manifold member 24 is laminated on an upper surface of the first manifold member 23. The first manifold member 23 and the second manifold member 24 have the same outside shape as the plates 31 to 35 and the vibration plate 22 in top plan view. The first manifold member 23 has an opening 23*a* for exposing the piezoelectric elements 25 therethrough. The second manifold member 24 has an opening 24*a* for exposing the piezoelectric elements 25 therethrough.

The first manifold member 23 has through holes 23*b* and grooves 23*c*. The through holes 23*b* penetrate the first manifold member 23 in the up-down direction. The grooves 23*c* may be recesses that may be recessed upward relative to a lower surface of the first manifold member 23 and each have an open lower end. As illustrated in FIG. 3, the first manifold member 23 has the through holes 23*b* and the grooves 23*c* in respective portions defined on opposite sides of the space for the piezoelectric elements 25 in the scanning direction. The through holes 23*b* are closer to the piezoelectric elements 25 than the grooves 23*c* are to the piezoelectric element 25 in the scanning direction.

Each through hole 23*b* constitutes a still further particular portion of a corresponding supply manifold 41 and faces a corresponding filter 22*a* disposed at the vibration plate 22. Each groove 23*c* constitutes a sixth portion of a corresponding return manifold 42 and faces a corresponding through hole 22*b* of the vibration plate 22.

The second manifold member 24 has grooves 24*b*. The grooves 24*b* may be recesses that may be recessed upward relative to a lower surface of the second manifold member 24 and each have an open lower end. As illustrated in FIG. 3, the second manifold member 24 has the grooves 24*b* in respective portions defined on opposite sides of the space for the piezoelectric elements 25 in the scanning direction. The grooves 24*b* are positioned above the respective through holes 23*b* and the respective grooves 23*c* of the first manifold member 23. More specifically, for example, each groove 24*b* extends over both of a corresponding through hole 23*b* and a corresponding groove 23*c*.

That is, the plate 34 of the channel member 21 and the second manifold member 24 define the supply manifolds 41. The filters 22*a* disposed at the vibration plate 22 are positioned inside the respective supply manifolds 41. In each supply manifold 41, ink is allowed to flow downward to pass through the filter 22*a*. The plate 32 of the channel member 21 and the first manifold member 23 define the return manifolds 42.

As illustrated in FIG. 2, the second manifold member 24 has an inlet 61 in its upper wall. The inlet 61 is positioned facing the downstream end portion (e.g., the right end portion in FIG. 2) of the supply manifold 41*a* in the conveyance direction. The inlet 61 is configured to allow ink to pass therethrough to flow into the supply manifold 41*a*. The second manifold member 24 has another inlet 62 in its upper wall. The inlet 62 is positioned facing the upstream end portion (e.g., the left end portion in FIG. 2) of the supply manifold 41*b* in the conveyance direction. The inlet 62 is configured to allow ink to pass therethrough to flow into the supply manifold 41*b*. The supply manifolds 41*a* and 41*b* are in fluid communication with the ink tank 90 via respective tubes connecting between the ink tank 90 and the inlets 61 and 62. The pump 91 is disposed between the ink tank 90 and the inlet 61 in an ink supply route. The pump 92 is disposed between the ink tank 90 and the inlet 62 in another ink supply route. The pumps 91 and 92 are configured to force ink into the corresponding supply manifolds 41*a* and 41*b* via the respective inlets 61 and 62.

The second manifold member 24 has an outlet 63 in its upper wall. The outlet 63 is positioned facing the upstream end portion (e.g., the left end portion in FIG. 2) of the return manifold 42*a* in the conveyance direction. The outlet 63 is configured to allow ink to pass therethrough to flow from the return manifold 42*a*. The second manifold member 24 has another outlet 64 in its upper wall. The outlet 64 is positioned facing the downstream end portion (e.g., the right end portion in FIG. 2) of the return manifold 42*b* in the conveyance direction. The outlet 64 is configured to allow ink to pass therethrough to flow from the return manifold 42*b*. The return manifolds 42*a* and 42*b* are in fluid communication with the ink tank 90 via respective tubes connecting between the ink tank 90 and the outlets 63 and 64. The pump 93 is disposed between the ink tank 90 and the outlet 63 in an ink return route. The pump 94 is disposed between the ink tank 90 and the outlet 64 in another ink return route. The pumps 93 and 94 are configured to force ink into the ink tank 90 via the respective outlets 63 and 64.

Hereinafter, a description will be provided on initial ink supply to the inkjet head 3. In a case where ink is supplied to the inkjet head 3 for the first time, the pumps 91 and 92 are driven to force ink to flow from the ink tank 90 into the supply manifolds 41*a* and 41*b* via the respective inlets 61 and 62. In the supply manifold 41*a* having the inlet 61 at its downstream end portion (e.g., the right end portion in FIG. 2) in the conveyance direction, ink supplied to the supply manifold 41*a* via the inlet 61 flows from downstream toward upstream in the conveyance direction (e.g., from right toward left in FIG. 2). Then, ink flows into each individual channel 49 via a corresponding communication path 44 in the arrangement order from the most downstream one of the individual channels 49 in the conveyance direction. Ink also flows into each dummy channel 49X positioned further upstream from the most upstream one of the individual channels 49 in the conveyance direction via a corresponding communication path 44.

In the supply manifold 41*b* having the inlet 62 at its upstream end portion (e.g., the left end portion in FIG. 2) in the conveyance direction, ink supplied to the supply manifold 41*b* via the inlet 62 flows into each individual channel 49 via a corresponding communication path 44 in the arrangement order from the most upstream one of the individual channels 49 in the conveyance direction. Ink also flows into each dummy channel 49X positioned further downstream from the most downstream one of the individual channels 49 in the conveyance direction via a corresponding communication path 44.

In the initial ink supply to the inkjet head 3, in addition to the individual channels 49, ink flows into the dummy channels 49X positioned opposite to the inlet 61 or 62 with respect to the endmost individual channel 49 that is farthest from the inlet 61 or 62 in the conveyance direction among the individual channels 49. In each of the pressure chamber rows 43*a* and 43*b*, the dummy channels 49X are positioned on opposite sides of the bypass path 48 in the conveyance direction. More specifically, for example, the first dummy channel 49X is positioned across the bypass path 48 from the endmost individual channel 49 and the second dummy channel 49X is positioned on the same side as the side where the endmost individual channel 49 is provided with respect to the bypass path 48. The first dummy channel 49X may impart less resistance to the flow of ink therethrough than the second dummy channel 49X imparts a resistance to the flow of ink therethrough. Such a configuration may thus ensure supply of ink to the first dummy channel 49X positioned across the bypass path 48 from the endmost individual channel 49. Consequently, such a configuration may reduce production of waste ink when ink is supplied to the inkjet head 3 for the first time.

Hereinafter, a description will be provided on ink circulation between the inkjet head 3 and the ink tank 90. In a case where ink circulation is implemented, the pump 91 is driven to force ink to flow from the ink tank 90 into the supply manifold 41*a* via the inlet 61 and the pump 92 is driven to force ink to flow from the ink tank 90 into the supply manifold 41*b* via the inlet 62. Some of ink supplied to the supply manifold 41*a* then flows therefrom into respective corresponding ones of the individual channels 49 and the dummy channels 49X via respective corresponding ones of the communication paths 44 after passing a corresponding filter 22*a*. Some of ink supplied to the supply manifold 41*b* then flows therefrom into respective corresponding ones of the individual channels 49 and the dummy channels 49X via respective corresponding ones of the communication paths 44 after passing a corresponding filter 22*a*. Some of ink supplied to the individual channels 49 and the dummy channels 49X then flows therefrom into the return manifold 42*a* or 42*b* via respective corresponding ones of the communication paths 46, each of which is in fluid communication with a corresponding one of the descenders 45 and 45X.

Some of ink supplied to the supply manifold 41*a* flows therefrom into the return manifold 42*a* via a corresponding bypass path 48 after passing through the corresponding filter 22*a*. Some of ink supplied to the supply manifold 41*b* flows therefrom into the return manifold 42*b* via a corresponding bypass path 48 after passing through the corresponding filter 22*a*. Then, the pump 93 is driven to force ink to flow into the ink tank 90 from the return manifold 42*a* via the outlet 63 and the pump 94 is driven to force ink to flow into the ink tank 90 from the return manifold 42*b* via the outlet 64.

A resistance Rb imparted to the flow of ink through a bypass path 48 is less than a combined resistance Ra that is the sum of individual resistances, each of which is a resistance imparted to the flow of ink through the path 70, a resistance imparted to the flow of ink through another path from the path 70 to an individual channel 49, and a resistance imparted to the flow of ink through a further path from the path 70 to a dummy channel 49X.

A cross-sectional area of each communication path 44, 46 in a plane perpendicular to the scanning direction has a size such that an average of pressures in an individual channel 49 or in a dummy channel 49X is negative. The scanning direction may correspond to a direction in which ink flows (hereinafter, referred to as the ink flow direction) in the bypass path 48.

The symbol "Ri" represents a channel resistance imparted to flow of ink through a channel from the pump 91, 92 for ink supply to an individual channel 49 or a dummy channel 49X via the supply manifold 41. The symbol "Ro" represents a channel resistance imparted to flow of ink through a channel from an individual channel 49 or a dummy channel 49X to the pump 93, 94 for ink collection via the return manifold 42. The symbol "Rc" represents a channel resistance imparted to flow of ink through an individual channel 49 or a dummy channel 49X. The symbol "Pn≥0)" represents a pressure of the pump 91, 92 for ink supply. The symbol "Po(≤0)" represents a pressure of the pump 93, 94 for ink collection. A size of the cross-sectional area and a length of a communication path 44 and a communication path 46 are determined so as to satisfy Formula 1.

$$2(RoPi+RiPo)+Rc(Pi+Po)\leq 0 \qquad \text{Formula 1}$$

Where the symbol "Pm(≤0)" represents an average of pressures in an individual channel 49 or in a dummy channel 49X when a meniscus is broken at a corresponding nozzle 47, 47X, the size of the cross-sectional area and the length of each of a communication path 44 and a communication path 46 is determined so as to satisfy Formula 2 in addition to Formula 2.

$$\{2(RoPi+RiPo)+Rc(Pi+Po)\}/(Ri+Rc+Ro)\geq Pm \qquad \text{Formula 2}$$

Features of First Illustrative Embodiment

Note that plural same components have the same or similar configuration and function in the same or similar manner to each other. Therefore, one of the plural same components will be referred. According to the illustrative embodiment, the inkjet head 3 includes the plurality of individual channels 49, the supply manifold 41, the filter 22*a*, the return manifold 42, and the bypass path 48. The individual channels 49 each have a corresponding nozzle 47. The supply manifold 41 is in fluid communication with the individual channels 49. The filter 22*a* is disposed in the supply manifold 41. The return manifold 42 is in fluid communication with the individual channels 49. The bypass path 48 is positioned between a channel row consisting of the individual channels 49 and the filter 22*a* in the direction in which liquid flows. The bypass path 48 extends from the supply manifold 41. The bypass path 48 provides fluid communication between the supply manifold 41 and the return manifold 42 not via the individual channels 49. Positioning the bypass path 48 as such may enable ink to be circulated not via the individual channels 49, each of which may impart a relatively high resistance to the flow of ink therethrough. Further, such a configuration may enable ink to flow into the bypass path 48 after foreign matter included in ink is removed by the filter 22*a*. That is, ink from which foreign matter has been removed may be circulated, thereby reducing or preventing foreign matter to adhere to wall surfaces of a circulation path or remain in the circulation path. Thus, increase of a channel resistance may be reduced. Consequently, a sufficient amount of ink may be surely circulated.

A resistance Rb imparted to the flow of ink through a bypass path 48 is less than a combined resistance Ra that is the sum of individual resistances, each of which is a resistance imparted to the flow of ink through the path 70, a resistance imparted to the flow of ink through another path from the path 70 to an individual channel 49, and a resistance imparted to the flow of ink through a further path from the path 70 to a dummy channel 49X. Such a configuration may thus surely increase the amount of ink to be circulated via the bypass path 48 as compared with a case where ink is circulated via the individual channels 49 and the dummy channels 49X.

In the illustrative embodiment, the cross section of the bypass path 48 in a plane perpendicular to the scanning direction may have a rectangular shape. The scanning direction may correspond to an ink flow direction in the bypass path 48. With this configuration, a damping coefficient of the bypass path 48 may be greater than a damping coefficient of a bypass path having a circular cross section, thereby reducing resonance in the return manifold 42 sufficiently. Consequently, such a configuration may reduce or prevent degradation of a property of ejecting ink from the nozzles 47 caused by effect of such resonance.

The path 70 is defined by the first surface 71 and the second surface 72 intersecting the first surface 71. The bypass path 48 is defined at the corner where the first surface 71 and the second surface 72 intersect each other. Providing the bypass path 48 at the corner may reduce or prevent ink stagnation at the corner where ink tends to stay or remain.

The cross-sectional area of each communication path 44, 46 in a plane perpendicular to the ink flow direction has a size such that an average of pressures in an individual channel 49 or in a dummy channel 49X is negative. A communication path 44 connects between an individual channel 49 and a supply manifold 41. A communication path 46 connects between an individual channel 49 and a return manifold 42. That is, maintaining the pressure in the individual channels 49 and the dummy channels 49X at a negative pressure may reduce or prevent ink from leaking from the nozzles 47 and 47X.

In the illustrative embodiment, in each pressure chamber row 43*a* or 43*b*, two dummy channels 49X (e.g., the first and second dummy channels 49X) are positioned opposite to the inlet 61 or 62 with respect to the individual channel 49 (i.e., the endmost individual channel 49) that is farthest from the inlet 61 or 62 with respect to the conveyance direction among the individual channels 49. Ink may be supplied to the supply manifold 41 via the inlet 61 or 62. In each pressure chamber row 43*a* or 43*b*, the bypass path 48 is positioned across the second dummy channel 49X next to the endmost individual channel 49 from the inlet 61 or 62. Thus, a sufficient amount of ink may be flowed into the second dummy channel 49X that is closer to the inlet 61 or 62 than the bypass path 48 to the inlet 61 or 62, thereby reducing precipitation of particles included in ink in the second dummy channel 49X. Consequently, change in the property of the second dummy channel 49X may be reduced or prevented, thereby reducing affection on ejection property of the nozzle 47 that is in fluid communication with the individual channel 49 next to the second dummy channel 49X.

While the disclosure has been described in detail with reference to the specific embodiment thereof, this is merely an example, and various changes, arrangements and modifications may be applied therein without departing from the spirit and scope of the disclosure.

Figure 6:
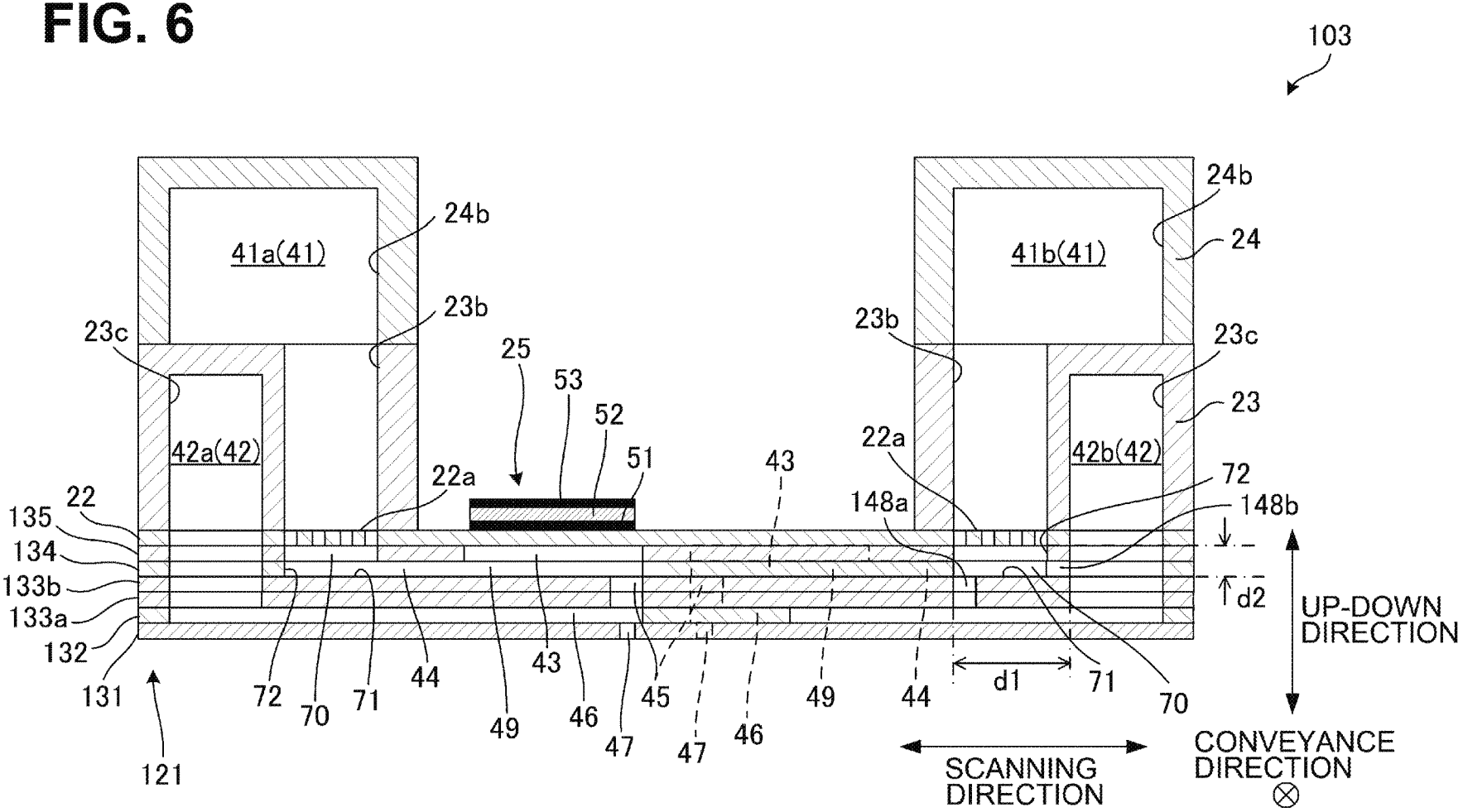
FIG. 6 is a sectional view of an inkjet head according to a first modification of the illustrative embodiment of the disclosure.

Referring to FIG. 6, an inkjet head 103 according to a first modification will be described. The inkjet head 103 has bypass paths 148*a* and 148*b* (only one each is illustrated). The bypass paths 148*a* may have the same configuration as each other and the bypass paths 148*b* may have the same configuration as each other, and therefore, a description will be provided on one of each of the bypass paths 148*a* and 148*b*. Other plural same components may also have the same or similar configuration and function in the same or similar manner to each other. Therefore, one of the plural same components will be described. The bypass paths 148*a* and 148*b* both provide fluid communication between a supply manifold 41 and a return manifold 42. The bypass paths 148*a* and 148*b* are positioned between a channel row consisting of corresponding ones of the individual channels 49 and dummy channels 49X and a filter 22*a* in the ink flow direction. The bypass paths 148*a* and 148*b* extend from the supply manifold 41. The bypass path 148*a* (e.g., the first bypass path) may impart less resistance to the flow of ink therethrough than the bypass path 148*b* (e.g., the second bypass path) imparts a resistance to the flow of ink therethrough.

The bypass path 148*a* extends in the up-down direction. The bypass path 148*a* has an opening defined at the first surface 71 defining the bottom surface of a path 70. The first surface 71 has one end and the other end in the scanning direction. The one end of the first surface 71 is closer to a channel row consisting of the individual channels 49 than the other end of the first surface 71 is to the channel row in the scanning direction. The opening of the bypass path 148*a* is defined at the one end portion of the first surface 71. The bypass path 148*a* has a perfect circular cross section in a plane perpendicular to the up-down direction. The bypass path 148*b* is provided in a similar manner to the bypass path 48 of the illustrative embodiment. More specifically, for example, the bypass path 148*b* extends in the scanning direction. The bypass path 148*b* has an opening defined at a lower end portion of the second surface 72. The second surface 72 defines a side surface of the path 70 that is a surface closer to an end of the inkjet head 3 in the scanning direction (e.g., closer to the return manifold 42) than an opposite side surface of the path 70 in the scanning direction. Like the bypass path 48, the bypass path 148*b* has a rectangular cross section in a plane perpendicular to the scanning direction (e.g., a direction parallel to the up-down direction).

The path 70 has a dimension d1 in the scanning direction and a dimension d2 (e.g., a height) in the up-down direction. The dimension d1 is greater than the dimension d2. The bypass path 148*a* has one end and the other end. The one end of the bypass path 148*a* is closer to a channel row consisting of corresponding ones of the individual channels 49 and dummy channels than to the filter 22*a*. The other end of the bypass path 148*a* is connected to the return manifold 42. The bypass path 148*b* has one end and the other end. The one end of the bypass path 148*b* is closer to the filter 22*a* than to the channel row. The other end of the bypass path 148*b* is connected to the communication paths 46. That is, a distance from the filter 22*a* to the bypass path 148*a* is different from a distance from the filter 22*a* to the bypass path 148*b*.

In the first modification, the bypass path 148*a* and the bypass path 148*b* are aligned with each other in the conveyance direction. Nevertheless, in other embodiments, for example, the bypass path 148*a* and the bypass path 148*b* might not necessarily be aligned with each other in the conveyance direction.

A channel member 121 includes a plurality of, for example, six plates 131, 132, 133*a*, 133*b*, 134, and 135 laminated one above another in this order from below. The plates 131, 132, 134, and 135 may have the same or similar configuration to the plates 31, 32, 34, and 35, respectively. The plates 133*a* and 133*b* correspond to the plate 33 of the illustrative embodiment. The plates 133*a* and 133*b* may have the same configuration, and therefore, the plate 133*a* will be representatively described.

Figure 7:
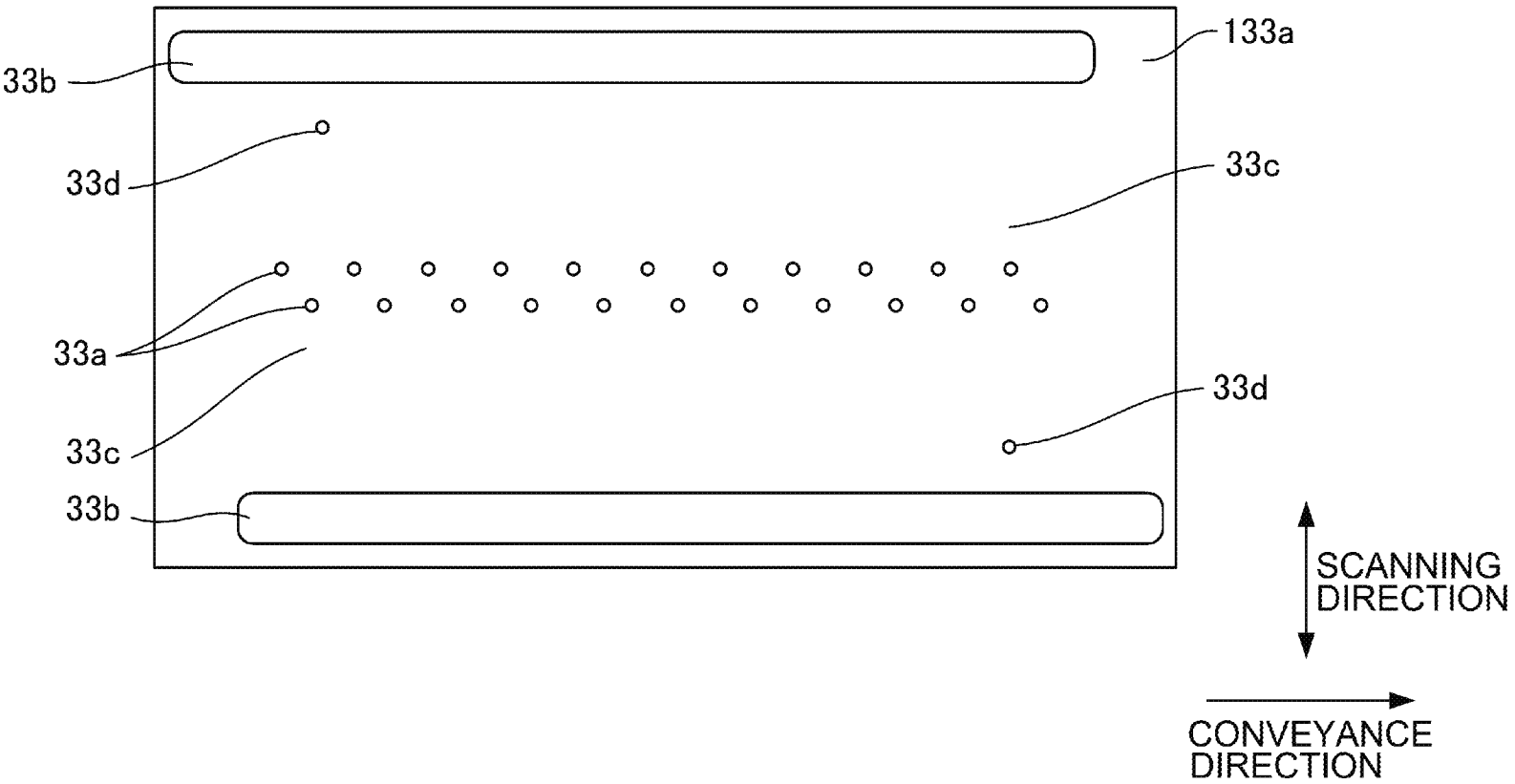
FIG. 7 is a plan view of one of plates constituting a channel member of FIG. 6 according to the first modification of the illustrative embodiment of the disclosure.

As illustrated in FIG. 7, the plate 133*a* has through holes 33*a*, through holes 33*b*, and wall portions 33*c*. Each through hole 33*a* constitutes a further particular portion of a corresponding descender 45, 45X. Each through hole 33*b* constitutes a second portion of a corresponding return manifold 42. Each wall portion 33*c* serves as an upper surface of corresponding communication paths 46. The plate 133*a* further has perfect circular through holes 33*d*. Each through hole 33*d* constitutes a particular portion of the bypass path 148*a*. As illustrated in FIG. 6, each through hole 33*d* is positioned so as to overlap a corresponding through hole 32*b* constituting a first portion of a return manifold 42 in top plan view. In addition, each through hole 33*d* is positioned so as to overlap a corresponding through hole 34*b* constituting a particular portion of a supply manifold 41 in top plan view. The perfect circular through hole 33*d* of the plate 133*a* and the perfect circular through hole 33*d* of the plate 133*b* are connected to each other to define the bypass path 148*a*.

That is, the plates 133*a* and 133*b* define the bypass paths 148*a*. As is the case with the plate 34 defining the bypass paths 48, the plate 134 defines the bypass paths 148*b*.

In the first modification, the bypass paths 148*a* and 148*b* are positioned between the channel row consisting of corresponding ones of the individual channels 49 and dummy channels 49X and the filter 22*a* in the ink flow direction, and the bypass paths 148*a* and 148*b* extend from the supply manifold 41. Consequently, a sufficient amount of ink may be surely circulated as is the case with the illustrative embodiment.

The one end of the bypass path 148*a* is closer to the channel row than to the filter 22*a*. The one end of the bypass path 148*b* is closer to the filter 22*a* than to the channel row. The bypass path 148*a* may impart less resistance to the flow of ink therethrough than the bypass path 148*b* imparts a resistance to the flow of ink therethrough. Thus, the bypass path 148*a* that is closer to the channel row than the bypass path 148*b* to the channel row may allow more ink to pass therethrough than the bypass path 148*b*. Consequently, such a configuration may supply ink to the respective individual channels 49 without causing ink precipitation.

In the first modification, the perfect circular through hole 33*d* of the plate 133*a* and the perfect circular through hole 33*d* of the plate 133*b* are connected to each other to define the bypass path 148*a*. The plates 133*a* and 133*b* each have perfect circular through holes 33*d*. Thus, even if the plates 133*a* and 133*b* are misaligned with each other in any direction in a plane perpendicular to the laminating direction in a laminating process, an area of a region where the through hole 33*d* of the plate 133*a* and the through hole 33*d* of the plate 133*b* overlap each other may be constant as long as displacement amounts of the plates 133*a* and 133*b* are equal to each other. Consequently, such a configuration may equalize affection of such lamination misalignment of the plates 133*a* and 133*b*.

In the first modification, two bypass paths 148*a* and 148*b* are connected to the path 70 and the distance from the filter 22*a* to the bypass path 148*a* is different from the distance from the filter 22*a* to the bypass path 148*b*. Nevertheless, in other embodiments, for example, three or more bypass paths may be connected to the path 70 and distances from the filter 22*a* to the respective bypass paths may be different from each other.

Figure 8:
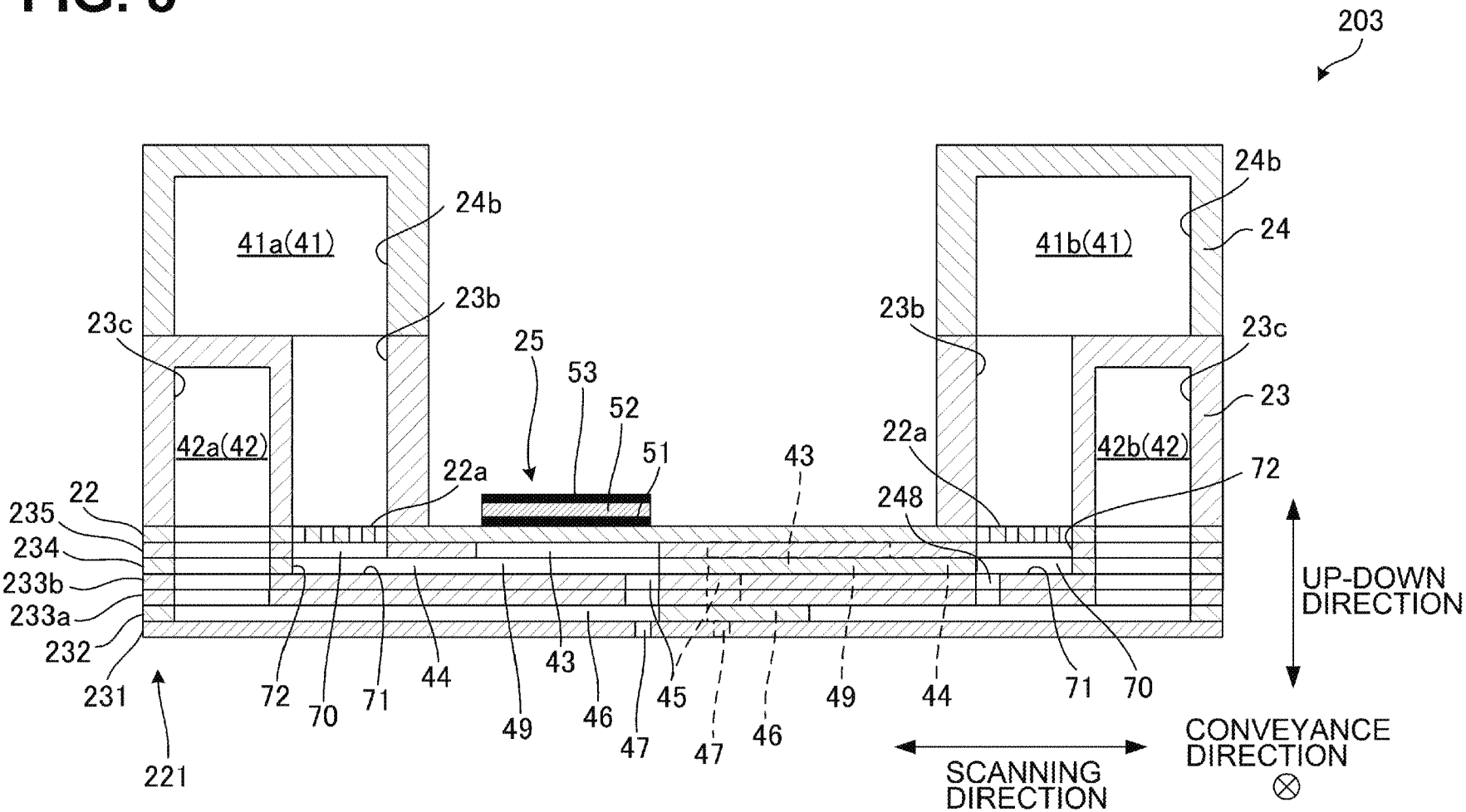
FIG. 8 is a plan view of an inkjet head according to a second modification of the illustrative embodiment of the disclosure.

Referring to FIG. 8, an inkjet head 203 according to a second modification will be described. The inkjet head 203 has bypass paths 248 (only one of which is illustrated). The bypass paths 248 may have the same configuration as each other, and therefore, a description will be provided on one of the bypass paths 248. Other plural same components may also have the same or similar configuration and function in the same or similar manner to each other. Therefore, one of the plural same components will be described. The bypass path 248 extends in the up-down direction. The bypass path 248 has an opening defined at a first surface 71 defining the bottom surface of a path 70. The first surface 71 has one end and the other end in the scanning direction. The one end of the first surface 71 is closer to a channel row consisting of the individual channels 49 than the other end of the first surface 71 is to the channel row. The opening of the bypass path 148*a* is defined at the one end portion of the first surface 71. Such a configuration of the bypass path 248 is different from the configuration of the bypass path 48 according to the illustrative embodiment. A channel member 221 includes a plurality of, for example, six plates 231, 232, 233*a*, 233*b*, 234, and 235 laminated one above another in this order from below. The plate 233*a* and the plate 233*b* have perfect circular through holes. The perfect circular through hole of the plate 233*a* and the perfect circular through hole 33*d* of the plate 233*b* are connected to each other to define the bypass path 248. That is, the bypass path 248 has a perfect circular cross section in a plane perpendicular to the up-down direction.

In the first modification, the plates 133*a* and 133*b* define the bypass path 148*a*. In the second modification, the plates 233*a* and 233*b* define the bypass path 248. Nevertheless, in other embodiments, for example, the channel member 121 may include either one of the plates 133*a* and 133*b* and the one of the plates 133*a* and 133*b* may define the bypass path 148*a*. In still other embodiments, for example, the channel member 221 may include either one of the plates 233*a* and 233*b* and the one of the plates 233*a* and 233*b* may define the bypass path 248.

In the first and second modifications, the bypass path 148*a*, 248 extends in the up-down direction. The bypass path 148*a*, 248 has an opening defined at the first surface 71 defining the bottom surface of the path 70. The opening of the bypass path 148*a*, 248 is defined at the one end portion of the first surface 71 that is closer to a channel row consisting of corresponding one of the individual channels 49 and dummy channels 49X than the other end of the first surface 71 is to the channel row. Nevertheless, in other embodiments, for example, the bypass path 148*a*, 248 may have an opening defined at the first surface 71. The opening of the bypass path 148*a*, 248 may be defined at the other end portion of the first surface 71 that may be opposite to the one end portion thereof in the scanning direction (e.g., closer to the return manifold 42 in the scanning direction).

Figure 9:
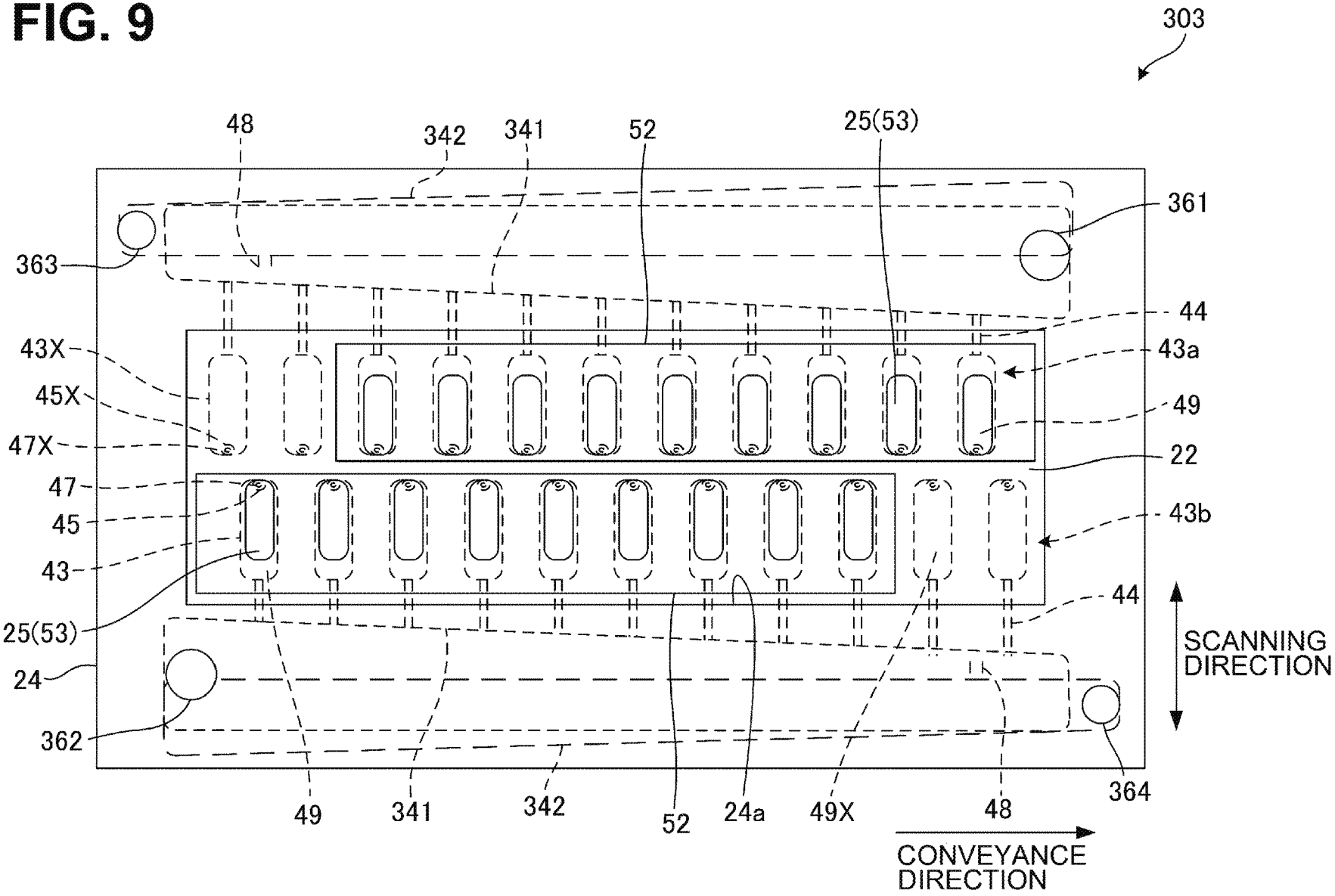
FIG. 9 is a plan view of an inkjet head according to a third modification of the illustrative embodiment of the disclosure.

Referring to FIG. 9, an inkjet head 303 according to a third modification will be described. The inkjet head 303 includes supply manifolds 341 and return manifolds 342 whose widths are not constant in the scanning direction. The supply manifolds 341 have the same configuration as each other and the return manifolds 342 have the same configuration as each other, and therefore, a description will be provided on one of each of the supply manifolds 341 and the return manifolds 342. Other plural same components may also have the same or similar configuration and function in the same or similar manner to each other. Therefore, one of the plural same components will be described. That is, the supply manifold 341 has ends in the conveyance direction. The ends of the supply manifold 341 each extend in the scanning direction. The end having an inlet 361, 362 has the widest width. The supply manifold 341 becomes gradually narrowed as the supply manifold 341 extends away from the inlet 361, 362. The return manifold 342 has ends in the conveyance direction. The ends of the return manifold 342 each extend in the scanning direction. The end opposite to the end having an outlet 363, 364 has the widest width. The return manifold 342 becomes gradually narrowed as the return manifold 342 extends toward the outlet 363, 364.

The supply manifold 341 and the return manifold 342 each have a constant height with respect to the conveyance direction. Thus, a cross-sectional area of a cross section of the supply manifold 341 in a plane perpendicular to the ink flow direction (e.g., a cross section perpendicular to the conveyance direction) in the supply manifold 341 becomes gradually smaller as the supply manifold 341 extends away from the inlet 361, 362. A cross-sectional area of a cross section of the return manifold 342 in a plane perpendicular to the ink flow direction (e.g., a cross section perpendicular to the conveyance direction) in the return manifold 342 becomes gradually smaller as the return manifold 342 extends toward the outlet 363, 364.

In the second modification, in each of the supply manifold 341 and the return manifold 342, a further downstream portion in the ink flow direction has a smaller cross-sectional area in a plane perpendicular to the ink flow direction. Such a configuration may thus reduce or prevent ink stagnation in the supply manifold 341 and the return manifold 342.

In third modification, while the heights of the supply manifold 341 and the return manifold 342 are constant with respect to the conveyance direction, the widths of the supply manifold 341 and the return manifold 342 are not constant in the scanning direction. Nevertheless, in other embodiments, for example, the widths of the supply manifold 341 and the return manifold 342 may be constant with respect to the scanning direction and the heights of the supply manifold 341 and the return manifold 342 might not necessarily be constant with respect to the conveyance direction. In such a case, the supply manifold 341 may have ends in the conveyance direction. The ends of the supply manifold 341 may each extend in the scanning direction. The end having an inlet 361, 362 may have the highest height. The supply manifold 341 may become gradually lowered as the supply manifold 341 extends away from the inlet 361, 362. The return manifold 342 may have ends in the conveyance direction. The ends of the return manifold 342 may each extend in the scanning direction. The end opposite to the end having an outlet 363, 364 may have the highest height. The return manifold 342 may become gradually lowered as the return manifold 342 extends toward the outlet 363, 364.

Figure 10:
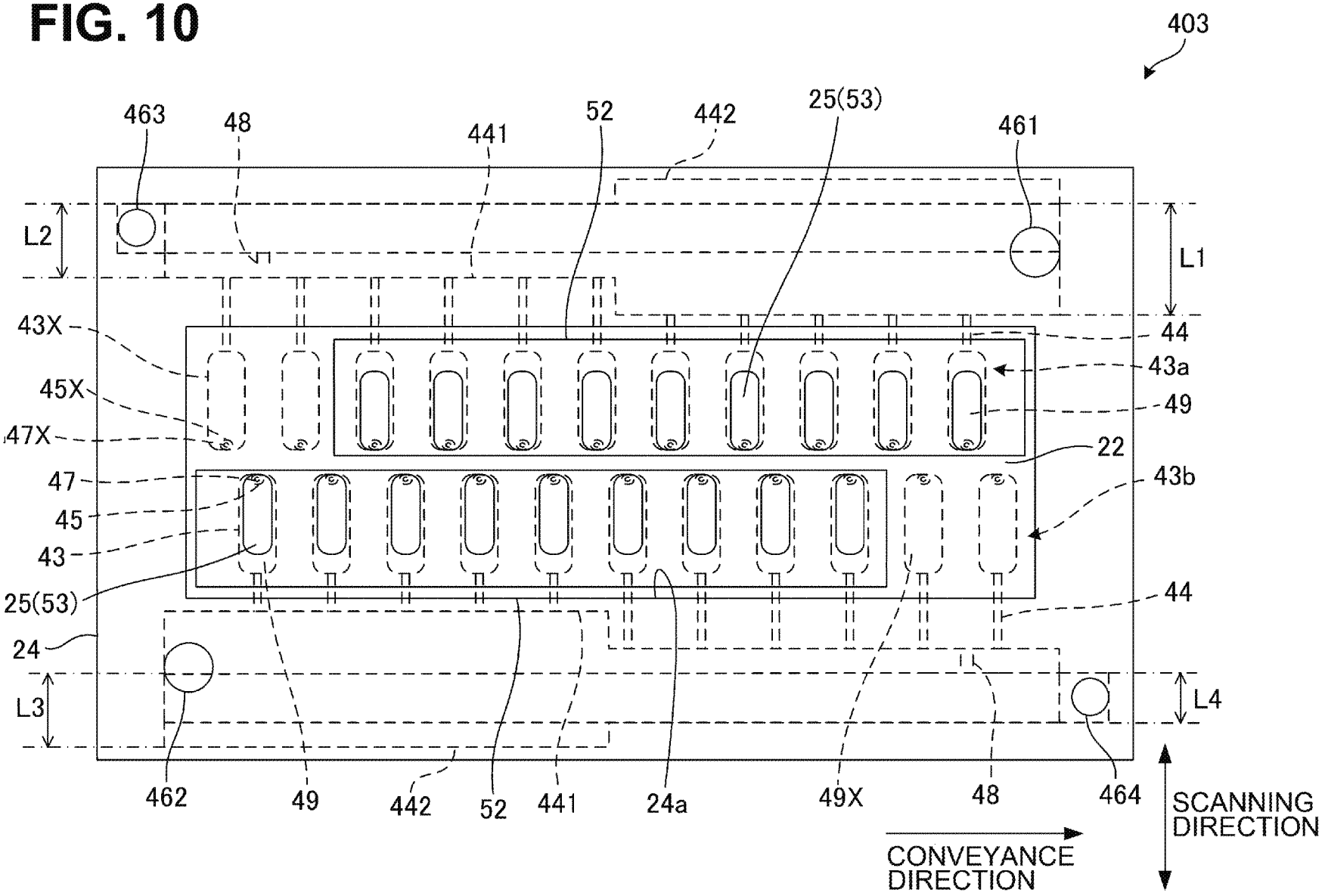
FIG. 10 is a plan view of an inkjet head according to a fourth modification of the illustrative embodiment of the disclosure.

Referring to FIG. 10, an inkjet head 403 according to a fourth modification will be described. The inkjet head 403 includes supply manifolds 441 and return manifolds 442 whose widths are not constant in the scanning direction. The supply manifolds 441 have the same configuration as each other and the return manifolds 442 have the same configuration as each other, and therefore, a description will be provided on one of each of the supply manifolds 441 and the return manifolds 442. Other plural same components may also have the same or similar configuration and function in the same or similar manner to each other. Therefore, one of the plural same components will be described. That is, the supply manifold 441 has ends in the conveyance direction. The ends of the supply manifold 441 each extend in the scanning direction. The end having an inlet 461, 462 has the widest width. The supply manifold 441 includes a narrowed portion. The supply manifold 441 becomes narrowed stepwise as the supply manifold 241 extends away from the inlet 461, 462. The return manifold 442 has ends in the conveyance direction. The ends of the return manifold 442 each extend in the scanning direction. The end opposite to the end having an outlet 463, 464 has the widest width. The return manifold 442 has a narrowed portion. The return manifold 442 becomes narrowed stepwise as the return manifold 442 extends toward the outlet 463, 464.

The supply manifold 441 has a width L1 from the center of the supply manifold 341 in the conveyance direction to its end having the inlet 461, 462, and a width L2(<L1) from the center of the supply manifold 341 to the other end opposite to the end having the inlet 461, 462 in the conveyance direction. That is, the supply manifold 441 includes a portion having a relatively wide width L1 and another portion having a relatively narrow width L2. The return manifold 442 includes a portion having a relatively wide width L3 and another portion having a relatively narrow width L4. The portion having the width L3 may include the end opposite to the end having the outlet 463, 464 with respect to the conveyance direction. The portion having the width L4 may include the end having the outlet 463, 464. The supply manifold 441 and the return manifold 442 may each include three or more portions having respective different widths.

The supply manifold 441 and the return manifold 442 each have a constant height with respect to the conveyance direction. Thus, a cross-sectional area of a cross section of the supply manifold 441 in a plane perpendicular to the ink flow direction (e.g., a cross section perpendicular to the conveyance direction) in the supply manifold 341 becomes smaller stepwise as the supply manifold 341 extends away from the inlet 461, 462. A cross-sectional area of a cross section of the return manifold 442 perpendicular to the ink flow direction (e.g., a cross section perpendicular to the conveyance direction) in the return manifold 342 becomes smaller stepwise as the return manifold 342 extends toward the outlet 463, 464.

Such a configuration may thus reduce or prevent ink stagnation in the supply manifold 441 and the return manifold 442 as is the case with the second modification.

In fourth modification, while the heights of the supply manifold 441 and the return manifold 442 are constant with respect to the conveyance direction, the widths of the supply manifold 441 and the return manifold 442 are not constant in the scanning direction. Nevertheless, in other embodiments, for example, the widths of the supply manifold 441 and the return manifold 442 may be constant with respect to the scanning direction and the heights of the supply manifold 441 and the return manifold 442 might not necessarily be constant with respect to the conveyance direction. In such a case, the supply manifold 441 may have ends in the conveyance direction. The ends of the supply manifold 441 may each extend in the scanning direction. The end having an inlet 461, 462 may have the highest height. The supply manifold 441 may become lowered stepwise as the supply manifold 441 extends away from the inlet 461, 462. The return manifold 442 may have ends in the conveyance direction. The ends of the return manifold 442 may each extend in the scanning direction. The end opposite to the end having an outlet 463, 464 may have the highest height. The return manifold 442 may become lowered stepwise as the return manifold 442 extends toward the outlet 463, 464.

In the illustrative embodiment, the cross section of the bypass path 48 in a plane perpendicular to the scanning direction may have a rectangular shape. The scanning direction at the bypass path 48 may correspond to the ink flow direction in the bypass path 48. Nevertheless, in other embodiments, for example, the cross section of the bypass path 48 may be circle.

In the illustrative embodiment, the bypass path 48 is defined at the corner where the first surface 71 and the second surface 72 intersect each other. The first surface 71 defines the bottom surface of the path 70. The second surface 72 defines the side surface of the path 70. Nevertheless, in other embodiments, for example, the bypass path 48 may be defined at another portion of the path 70 other than the corner of the path 70.

In the illustrative embodiment, the lower surface of the bypass path 48 is flush with the bottom surface of the path 70. Nevertheless, the level of the lower surface of the bypass path 48 is not limited to the specific example. In light of prevention of ink stagnation on the lower surface of the path 70, the lower surface of the bypass path 48 is preferably at the same level or lower than the lower surface of the path 70. Nevertheless, in other embodiments, for example, the lower surface of the bypass path 48 may be higher than the bottom surface of the path 70.

In the illustrative embodiment, the cross-sectional area of each communication path 44, 46 in a plane perpendicular to the ink flow direction has a size and a length such that an average of pressures in an individual channel 49 or in a dummy channel 49X is negative. A communication path 44 connects between an individual channel 49 and a supply manifold 41. A communication path 46 connects between an individual channel 49 and a return manifold 42. Nevertheless, in other embodiments, for example, the cross-sectional area and the length of each communication path 44, 46 might not necessarily be set such that an average of pressures in an individual channel 49 or in a dummy channel 49X is negative.

In the illustrative embodiment, a single bypass path 48 is provided for the supply manifold 41*a* and the return manifold 42*a* and another single bypass path 48 is provided for the supply manifold 41*b* and the return manifold 42*b*. Nevertheless, in other embodiments, for example, two or more bypass paths 48 may be provided for a supply manifold 41 and a return manifold 42.

In the illustrative embodiment, in each pressure chamber row 43*a* or 43*b*, two dummy channels 49X are positioned opposite to the inlet 61 or 62 with respect to the individual channel 49 that is farthest from the inlet 61 or 62 with respect to the conveyance direction among the individual channels 49. Nevertheless, the number of dummy channels 49X is not limited to the specific example. In one example, one or three or more dummy channels 49X may be provided opposite to the inlet 61 or 62 with respect to the individual channel 49 that is farthest from the inlet 61 or 62 with respect to the conveyance direction among the individual channels 49. In another example, dummy channel 49X might not necessarily be provided.

In the illustrative embodiment, in each pressure chamber row 43*a* or 43*b*, the bypass path 48 is positioned across the second dummy channel 49X next to the endmost individual channel 49 from the inlet 61 or 62. Nevertheless, the position of the bypass path 48 is not limited to the specific example. In one example, at least one dummy channel 49X may be preferably provided between the bypass path 48 and the endmost individual channel 49 in the conveyance direction. That is, the bypass path 48 may be positioned opposite to the inlet 61 or 62 with respect to the dummy channel 49X that is farthest from the inlet 61 or 62 with respect to the conveyance direction among one or more dummy channels 49X. In another example, the bypass path 48 may be positioned between an individual channel 49 and a dummy channel 49X adjacent to each other. In still another example, the bypass path 48 may be positioned on the same side as the side where the inlet 61 or 62 is provided with respect to the individual channel 49 (i.e., the endmost individual channel 49) that is farthest from the inlet 61 or 62 with respect to the conveyance direction among the individual channels 49.

In the illustrative embodiment, no piezoelectric element 25 is disposed at the area overlapping the pressure chambers 43X corresponding to the dummy channels 49X in top plan view. Nevertheless, in other embodiments, for example, piezoelectric elements may be disposed at the area overlapping the pressure chambers 43X. In such a case, in one example, the individual electrodes 53 included in the respective piezoelectric elements 25 disposed at the area overlapping the pressure chambers 43X may be maintained at a constant potential. In another example, broken wires may be connected to the individual electrodes 53 disposed at the area overlapping the pressure chambers 43X.

In the illustrative embodiment, the dummy channels 49X have the same or similar configuration to the individual channels 49. That is, each dummy channel 49X includes a pressure chamber 43X, a descender 45X, and a nozzle 47X. Nevertheless, in other embodiments, for example, each dummy channel 49X might not necessarily include a nozzle 47X.

In the illustrative embodiment, the descenders 45 of the individual channels 49 and the descenders 45X of the dummy channels 49X are in fluid communication with the return manifold 42 via the respective corresponding communication paths 46. The dummy channel 49X that is farthest form the inlet 61 or 62 with respect to the conveyance direction among the dummy channels 49X requires less need for ink circulation, thereby not necessarily being in communication with the return manifold 42 via a communication path 46. Each of the individual channels 49 and each of the dummy channels 49X might not necessarily be in fluid communication with the return manifold 42 via a corresponding communication path 46.

In the illustrative embodiment, the filter 22*a* is disposed in the supply manifold 41 and the bypass path 48 is positioned between the channel row consisting of corresponding ones of the individual channels 49 and dummy channels 49X and the filter 22*a* in the ink flow direction. The bypass path 48 extends from the supply manifold 41. Nevertheless, in other embodiments, for example, a filter 22*a* may be positioned in a return manifold 42. In such a case, a bypass path 48 may be positioned between a channel row consisting of corresponding ones of the individual channels 49 and dummy channels 49X and a filter 22*a* in the ink flow direction. The bypass path 48 may extend from the return manifold 42.

In the illustrative embodiment, a piezoelectric actuator using piezoelectric elements is adopted. Nevertheless, in other embodiments, for example, another-type actuator such as a thermal actuator using heating elements or an electrostatic actuator using electrostatic force may be adopted.

The printing method adopted in the printer 1 is not limited to the serial printing. In other embodiments, for example, a line printing in which a head elongated in a sheet width direction and fixed at a certain position ejects ink droplets from nozzles may be adopted in the printer 1.

Liquid to be ejected from nozzles is not limited to ink but may be any liquid, for example, treatment liquid for flocculating or separating components of ink. The recording medium is not limited to a recording sheet P but may be, for example, a cloth or a substrate.

The disclosure may be applied to not only a printer but also a facsimile machine, a copying machine, or a multifunction device. Further, the disclosure may be applied to other liquid ejection devices used for purposes other than image recording. For example, the disclosure may be applied to a liquid ejection device configured to form conductive patterns on a surface of a substrate by ejecting conductive liquid onto the substrate.

What is claimed is:

1. A liquid ejection head configured to be supplied with liquid by a pump, the liquid ejection head comprising:

an individual channel having a nozzle;

a supply manifold being in fluid communication with the individual channel;

a filter disposed in the supply manifold;

a return manifold being in fluid communication with the individual channel; and a bypass path extending from the supply manifold, and providing fluid communication between the supply manifold and the return manifold not via the individual channel, wherein the bypass path is positioned between the individual channel and the filter in a direction in which liquid flows.

2. The liquid ejection head according to claim 1, wherein the supply manifold has a path between the individual channel and the filter in the direction in which liquid flows, and wherein a resistance imparted to flow of liquid through the bypass path is less than a combined resistance that is a sum of individual resistances, each of which is a resistance imparted to flow of liquid through the path and a resistance imparted to flow of liquid through another path from the path to the individual channel.

3. The liquid ejection head according to claim 1, wherein the bypass path has one end and another end, and wherein the one end of the bypass path is closer to the individual channel than to the filter.

4. The liquid ejection head according to claim 1, wherein the bypass path has a rectangular cross section in a plane perpendicular to the direction in which liquid flows.

5. The liquid ejection head according to claim 1, further comprising a plurality of members laminated one above another in a laminating direction, wherein each of the plurality of members has a perfect circular through hole penetrating therethrough, and wherein the through holes of the plurality of members are connected to each other to define the bypass path.

6. The liquid ejection head according to claim 1, wherein the supply manifold has a path between the individual channel and the filter in the direction in which liquid flows, wherein the path is defined by at least a first surface and a second surface of the supply manifold, and the second surface intersects the first surface, and wherein the bypass path is defined at a corner where the first surface and the second surface intersect each other.

7. The liquid ejection head according to claim 1, wherein the bypass path includes a first bypass path and a second bypass path each having one end and another end, wherein the first bypass path is positioned between the individual channel and the filter in the direction in which liquid flows and the first bypass path extends from the supply manifold, wherein the one end of the first bypass path is closer to the individual channel than to the filter, wherein the second bypass path is positioned between the individual channel and the filter in the direction in which liquid flows and the second bypass path extends from the supply manifold, wherein the one end of the second bypass path is closer to the filter than to the individual channel, and wherein the first bypass path is configured to impart less resistance to flow of liquid therethrough than the second bypass path imparts a resistance to flow of liquid therethrough.

8. The liquid ejection head according to claim 1, further comprising:

a first narrowed portion providing fluid communication between the individual channel and the supply manifold; and a second narrowed portion providing fluid communication between the individual channel and the return manifold, wherein the first narrowed portion and the second narrowed portion each have a cross-sectional area such that an average of pressures in the individual channel is negative.

9. The liquid ejection head according to claim 1, further comprising:

an inlet configured to allow liquid to pass therethrough to flow into the supply manifold; and a dummy channel configured to allow liquid to flow thereinto from the supply manifold, wherein the individual channel includes a first individual channel and a second individual channel, wherein the first individual channel is farther from the inlet than the second individual channel is from the inlet, wherein the dummy channel is positioned opposite to the inlet with respect to the first individual channel, and wherein the bypass path is positioned across the dummy channel from the inlet.

10. The liquid ejection head according to claim 9, wherein a cross-sectional area of a cross section of the supply manifold in a plane perpendicular to a direction in which liquid flows in the supply manifold becomes smaller as the supply manifold extends away from the inlet.

11. The liquid ejection head according to claim 1, further comprising an inlet configured to allow liquid to pass therethrough to flow into the supply manifold, wherein a cross-sectional area of a cross section of the supply manifold in a plane perpendicular to a direction in which liquid flows in the supply manifold becomes smaller as the supply manifold extends away from the inlet.

12. The liquid ejection head according to claim 1, further comprising an outlet configured to allow liquid to pass therethrough from the return manifold, wherein a cross-sectional area of a cross section of the return manifold in a plane perpendicular to a direction in which liquid flows in the return manifold becomes smaller as the return manifold extends toward the outlet.

13. The liquid ejection head according to claim 1, further comprising:

a channel member including the individual channel;

a manifold member including the supply manifold and the return manifold; and a filter member disposed between the channel member and the manifold member, the filter member including the filter, wherein the channel member includes the bypass path.

14. The liquid ejection head according to claim 13, wherein the channel member includes a first plate, a second plate, a third plate, a fourth plate, and a fifth plate laminated one above another in one direction, wherein the first plate has the nozzle, wherein the second plate includes a particular portion of a descender being in fluid communication with the nozzle, a first portion of the return manifold, and a first communication path providing fluid communication between the particular portion of the descender and the first portion of the return manifold, wherein the third plate includes a further particular portion of the descender, a second portion of the return manifold, and a first wall portion defining a wall surface defining the first communication path extending parallel to a perpendicular plane perpendicular to the one direction, wherein the fourth plate includes a particular portion of a pressure chamber being in fluid communication with the descender, a particular portion of the supply manifold, a second portion of the return manifold, and a second communication path providing fluid communication between the particular portion of the pressure chamber and the particular portion of the supply manifold, and wherein the fifth plate includes a further particular portion of the pressure chamber, a second wall portion defining a wall surface defining the second communication path extending parallel to the perpendicular plane, a further particular portion of the supply manifold, and a third portion of the return manifold.

15. The liquid ejection head according to claim 14, wherein the third plate defines the bypass path.

16. The liquid ejection head according to claim 15, wherein the third plate includes a plurality of plates, wherein each of the plurality of plates of the third plate has a perfect circular through hole penetrating therethrough, wherein the through holes of the plurality of plates of the third plate are connected to each other to define the bypass path, and wherein the bypass path extends in a laminating direction in which the channel member, the filter member, and the manifold member are laminated one above another, and the bypass path has a perfect circular cross section in a plane perpendicular to the laminating direction.

17. The liquid ejection head according to claim 14, wherein the fourth plate defines the bypass path.

18. The liquid ejection head according to claim 17, wherein the bypass path extends in a laminating direction in which the channel member, the filter member, and the manifold member are laminated one above another, and the bypass path has a rectangular cross section in a plane perpendicular to the laminating direction.

19. The liquid ejection head according to claim 14, wherein the bypass path includes a first bypass path and a second bypass path, wherein the third plate defines the first bypass path, wherein the fourth plate defines the second bypass path, and wherein the first bypass path is configured to impart less resistance to flow of liquid therethrough than the second bypass path imparts a resistance to flow of liquid therethrough.

20. The liquid ejection head according to claim 1, wherein the supply manifold includes a supply manifold that allows liquid to flow into the individual channel, wherein the return manifold includes a return manifold that allows liquid to flow thereinto from the supply manifold, and wherein the bypass path is configured to allow liquid to pass therethrough to flow from the supply manifold to the return manifold.

21. A liquid ejection head configured to be supplied with liquid by a pump, the liquid ejection head comprising:

an individual channel having a nozzle;

a supply manifold comprising a filter, and a particular portion, which constitutes a liquid flow path between the filter and the individual channel;

a return manifold configured to be in fluid communication with the individual channel; and a bypass path extending from the particular portion of the supply manifold to the return manifold, and configured to allow fluid communication between the supply manifold and the return manifold not via the individual channel.

* * * * *